US008714990B2

(12) United States Patent
Naito et al.

(10) Patent No.: US 8,714,990 B2
(45) Date of Patent: May 6, 2014

(54) CONNECTOR

(75) Inventors: Takeharu Naito, Tokyo (JP); Takaaki Kudo, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 61 days.

(21) Appl. No.: 13/635,264

(22) PCT Filed: Apr. 13, 2011

(86) PCT No.: PCT/JP2011/059141

§ 371 (c)(1),
(2), (4) Date: Sep. 14, 2012

(87) PCT Pub. No.: WO2011/132577

PCT Pub. Date: Oct. 27, 2011

(65) Prior Publication Data

US 2013/0012068 A1 Jan. 10, 2013

(30) Foreign Application Priority Data

Apr. 20, 2010 (JP) ..... 2010-097298

(51) Int. Cl.
*H01R 12/00* (2006.01)

(52) U.S. Cl.
USPC ..... 439/78; 439/83

(58) Field of Classification Search
USPC ..... 439/78, 83
See application file for complete search history.

(56) References Cited

U.S. PATENT DOCUMENTS 4,767,342 A * 8/1988 Sato ..... 439/78
5,030,107 A * 7/1991 Moon ..... 439/62
5,197,891 A * 3/1993 Tanigawa et al. ..... 439/83
7,513,793 B2 * 4/2009 Horst et al. ..... 439/427
7,704,082 B2 * 4/2010 Daily et al. ..... 439/83
8,047,857 B1 * 11/2011 Lu et al. ..... 439/83
8,092,236 B2 * 1/2012 Yang et al. ..... 439/83
2009/0317990 A1 * 12/2009 Mostoller et al. ..... 439/83

FOREIGN PATENT DOCUMENTS

JP 9-219234 A 8/1997
JP 2009-224249 A 10/2009
JP 2010-3688 A 1/2010

OTHER PUBLICATIONS

International Search Report dated May 24, 2011 issued in International Appln. No. PCT/JP2011/059141.

* cited by examiner

*Primary Examiner* — Gary Paumen
(74) *Attorney, Agent, or Firm* — Holtz, Holtz, Goodman & Chick, PC

(57) ABSTRACT

To provide a connector which is capable of reducing the amount of protrusion from the mounting surface of a substrate, and reducing the amount of exposure of contacts, and reducing a mounting area.

A housing 50 is formed by a housing main body 51 which is inserted into a cutout formed in an LED-mounted substrate, and a top plate portion 52 which is continuous with the housing main body 51 and opposes to a mounting surface of the LED-mounted substrate. The housing main body 51 accommodates a contact portion 34 of a contact 30, and is formed with a connector receiving portion 51*a* which receives a housing of the cable connector. The top plate portion 52 is formed with a holding portion-receiving portion 52*a* which receives a holding portion 31 of the contact 30, from an inserting direction DI orthogonal to a direction along which the housing main body 51 is continuous with the top plate portion 52. The connection portions 32 and 33 of the contact 30 are caused to laterally protrude, and front ends of the connection portions 32 and 33 are bent toward the housing 50.

10 Claims, 40 Drawing Sheets

CONNECTOR

This application is a U.S. National Phase Application under 35 USC 371 of International Application PCT/JP2011/059141 filed Apr. 13, 2011.

TECHNICAL FIELD

The present invention relates to a connector.

BACKGROUND ART

Conventionally, there has been known a connector assembly part of which is mounted on a substrate in such a manner that it protrudes from a mounting surface of the substrate, for supplying power to a light emitting diode (LED) mounted on the substrate (see PTL 1 mentioned hereinbelow).

This connector assembly includes a housing, contacts, and tabs.

The housing has two openings, two upper slots, two lower slots, and two protrusions.

The two openings are formed at a rear end of the housing (at an end on an opposite side of the housing to a side where a mating connector is received).

Two upper slots are formed at the rear end of the housing, such that they open in a side surface (front surface) and the rear end of the housing and communicate with respective ends of the above-mentioned openings.

The two lower slots are formed in the side surface (front surface) of the housing, such that they extend from a front end of the housing to the vicinity of the upper slots along the vertical direction of the housing. The upper end of each lower slot is formed as a shelf portion.

The protrusions are formed at the opposite side surfaces of the housing. Slots are formed in the respective protrusions. The slots extend in the vertical direction of the housing, and open in respective lower ends of the protrusions.

Each contact includes an insertion portion, a flat portion, a slope portion, and a mounting portion.

The insertion portion is a portion brought into contact with a mating connector, and extends in the vertical direction of the housing.

The flat portion is continuous with the insertion portion, and extends in the front-rear direction of the housing.

The slope portion is continuous with the flat portion, and extends along a direction slightly inclined with respect to the vertical direction of the housing, and a lower end of the slope portion is more distant from the housing than an upper end of the slope portion is. A surface of the slope portion toward the insertion portion is formed with a convex holding barb.

The mounting portion is continuous with the slope portion, and extends away from the housing in the front-rear direction of the housing.

Each tab includes an insertion portion, a mounting portion, and a bent portion.

Convex holding barbs are formed on respective front and rear surfaces of the insertion portion.

The mounting portion is substantially at right angles to the insertion portion, and includes a mounting surface opposing to a substrate. The bent portion links between the insertion portion and the mounting portion.

To fix each contact to the housing, it is only required to insert the insertion portion of the contact to the opening of the housing from above the housing, insert the flat portion of the contact to the upper slot of the housing, and hook the holding barb of the slope portion of the contact on the shelf portion of the associated lower slot.

To fix each tab to the housing, it is only required to insert the insertion portion of the tab to the slot of the associated protrusion from under the protrusion.

To mount the connector assembly on the substrate, first, the housing is inserted into an opening of the substrate, the mounting portion of each contact is disposed on a contact pad, and the mounting portion of each tab is disposed on a mounting pad of the substrate.

Thereafter, the mounting portion of the contact is soldered to the contact pad, and the mounting portion of the tab is soldered to the mounting pad of the substrate, respectively.

By the above process flow, the connector assembly is mounted on the substrate.

CITATION LIST

Patent Literature

[PTL 1] Japanese Laid-Open Patent Publication (Kokai) No. 2010-3688 (Paragraphs 0012 to 0017, FIGS. 3 and 5)

SUMMARY OF THE INVENTION

Technical Problem

In the above-described connector assembly, a construction is adopted in which the flat portions of the contacts are inserted into the upper slots of the housing along the vertical direction of the housing, the holding barbs of the slope portions of the contacts are hooked on the shelf portions of the lower slots of the housing, and the inserting portions of the tabs are inserted into the slots of the protrusions of the housing along the vertical direction of the hosing. This causes a portion of the connector assembly to protrude high from the mounting surface of the substrate. Therefore, if an LED is disposed adjacent to the connector assembly, light from the LED is blocked by the connector assembly.

Further, in the above-described connector assembly, the slope portions and mounting portions of the contacts are disposed outside the housing, and the flat portions of the contacts are exposed through the upper slots. Therefore, when a lighting device having an LED arranged adjacent to the connector assembly is lit, exposed portions (the slope portions, the mounting portions, etc.) of the contacts appear darker than the other portions, and there is a fear that unevenness in brightness is caused.

Further, since the mounting portions of the contacts and the mounting portions of the tabs protrude from the side surface of the housing, there is a fear that the connector assembly becomes larger in size, and the proportion of the mounting area of the connector assembly to the substrate becomes larger.

The present invention has been made in view of these circumstances, and an objective thereof is to provide a connector which is capable of reducing the amount of protrusion from the mounting surface of a substrate, and reducing the amount of exposure of contacts, and reducing a mounting area.

Solution of Problem

As the solution of the above problem, the present invention provides a connector mounted on a substrate, for being fitted to a mating connector, the connector including a contact, and a housing which holds the contact, wherein the contact includes a holding portion which is held by the housing, a connection portion which is continuous with the holding portion and is connected to the mounting surface of the substrate, and a contact portion which is continuous with the holding portion and is brought into contact with the mating contact of the mating connector, wherein the housing includes a housing main body which is inserted in a inserted portion formed in the substrate, and a top plate portion which is continuous with the housing main body and opposes to the substrate, wherein the housing main body has a connector receiving portion formed therein which accommodates the contact portion and receives the mating housing of the mating connector, wherein the top plate portion has a holding portion-receiving portion formed therein which receives the holding portion from an inserting direction orthogonal to a direction along which the housing main body is continuous with the top plate portion, and wherein the connection portion protrudes from the top plate portion in a direction parallel to the inserting direction, and the front end of the contact portion is bent toward the housing.

As described above, since the holding portion-receiving portion is formed in the top plate portion receives the holding portion of the contact, from the inserting direction orthogonal to the direction along which the housing main body is continuous with the top plate portion, the height dimension of the top plate portion can be reduced, and the amount of protrusion of the connector from the mounting surface of the substrate can be reduced.

Further, since the holding portion-receiving portion which receives the holding portion of the contact, from the inserting direction orthogonal to the direction along which the housing main body is continuous with the top plate portion, is formed in the top plate portion, the top plate portion can cover most part of the contact, and the amount of exposure of the contact can be reduced.

Further, since the connection portion of the contact protrudes from the top plate portion in the direction orthogonal to the direction along which the housing main body is continuous with the top plate portion, and the front end of the connection portion is bent toward the housing, the connection portion of the contact does not protrude in the direction orthogonal to the thickness direction of the top plate portion.

Preferably, the holding portion is flat plate-shaped, and the holding portion includes a first protrusion which bites into an inner wall surface of the holding portion-receiving portion and a second protrusion which urges an inner wall surface of the holding portion-receiving portion.

Preferably, the contact almost in its entirety is covered by the top plate portion when the top plate portion is viewed from above.

Preferably, the connection portion is substantially U-shaped.

Preferably, the contact includes the connection portion in plurality.

The above and other objects, features and advantages of the present invention will become more apparent from the following detailed description taken in conjunction with the accompanying drawings.

Advantageous Effects of Invention

According to the invention, it is possible to provide a connector which is capable of reducing the amount of protrusion from the mounting surface of a substrate, and reducing the amount of exposure of contacts, and reducing a mounting area.

DESCRIPTION OF EMBODIMENTS

First, a description will be given of a connector according to a first embodiment of the invention with reference to FIGS. 1 to 21.

Figure 1:
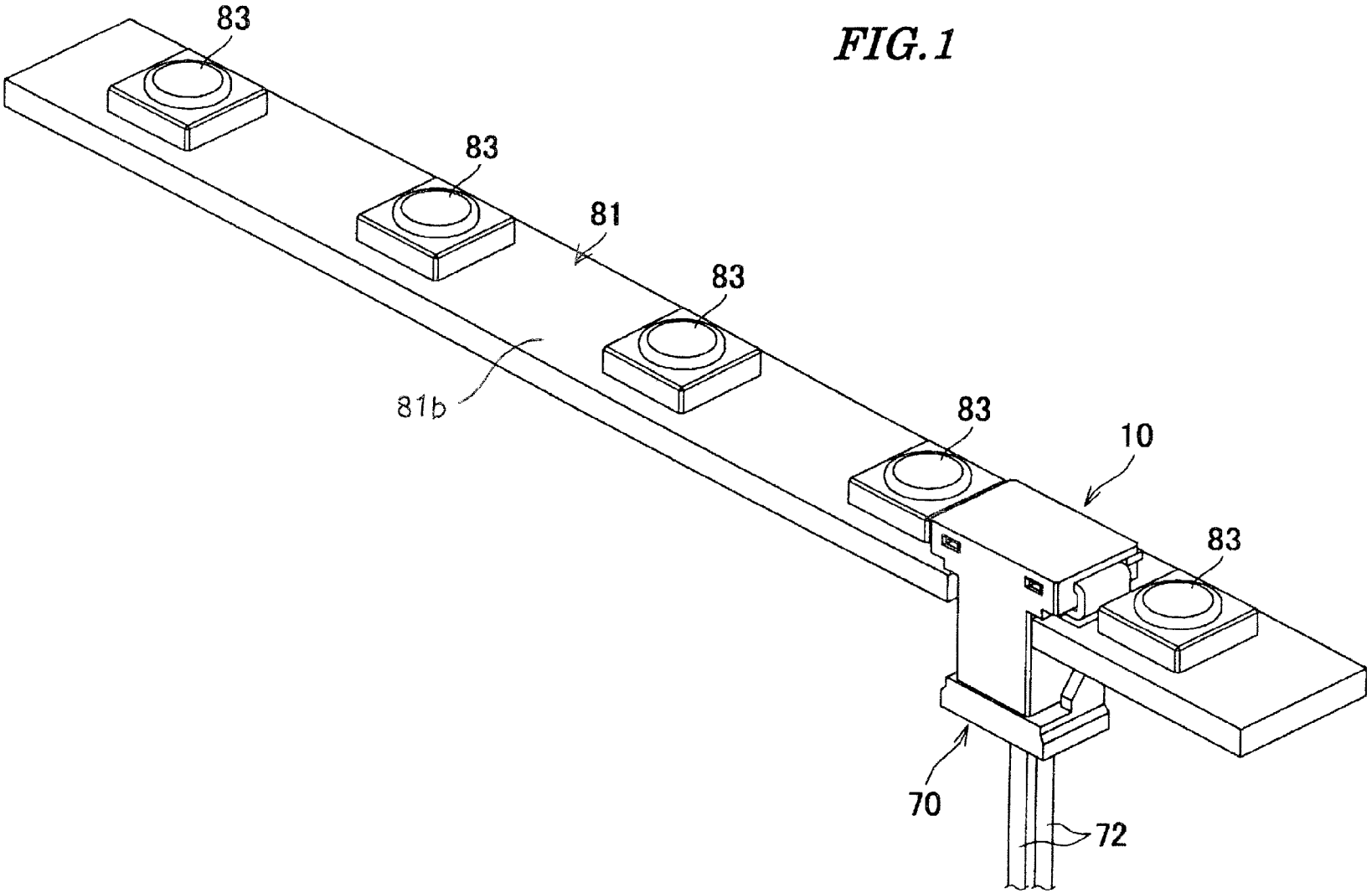
FIG. 1 is a perspective view of a connector according to a first embodiment of the present invention in a state of use.

As shown in FIG. 1, a connector 10 is mounted on an LED-mounted substrate (substrate) 81 on which a plurality of LEDs 83 are mounted, and connects a cable 72 of a cable connector (mating connector) 70 to the LED-mounted substrate 81 to thereby make it possible to supply power to the plurality of LEDs 83 from a power source, not shown. According to this embodiment, the LEDs 83 are light sources of backlight (not shown).

Figure 2:
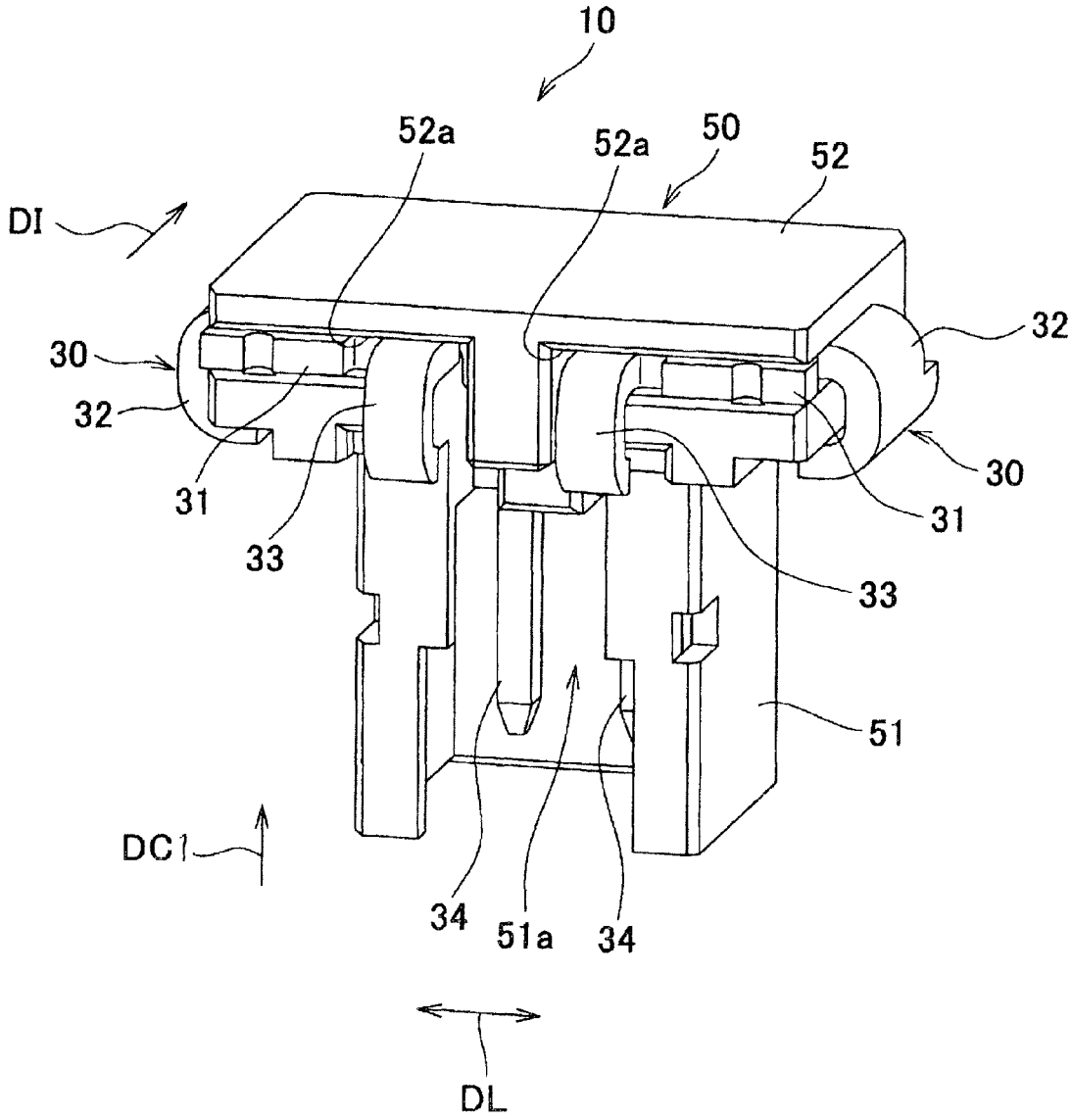
FIG. 2 is a perspective view of the connector shown in FIG. 1.
Figure 3:
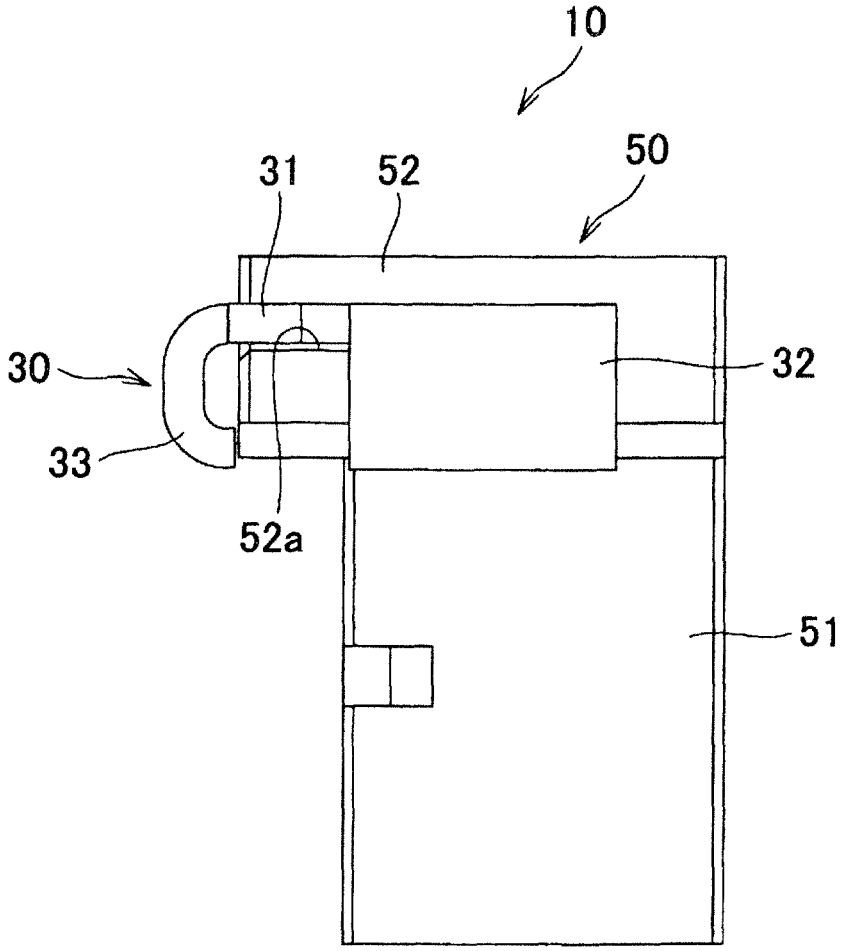
FIG. 3 is a side view of the connector shown in FIG. 2.

As shown in FIGS. 2 and 3, the connector 10 comprises two contacts 30 and one housing 50.

Figure 4:
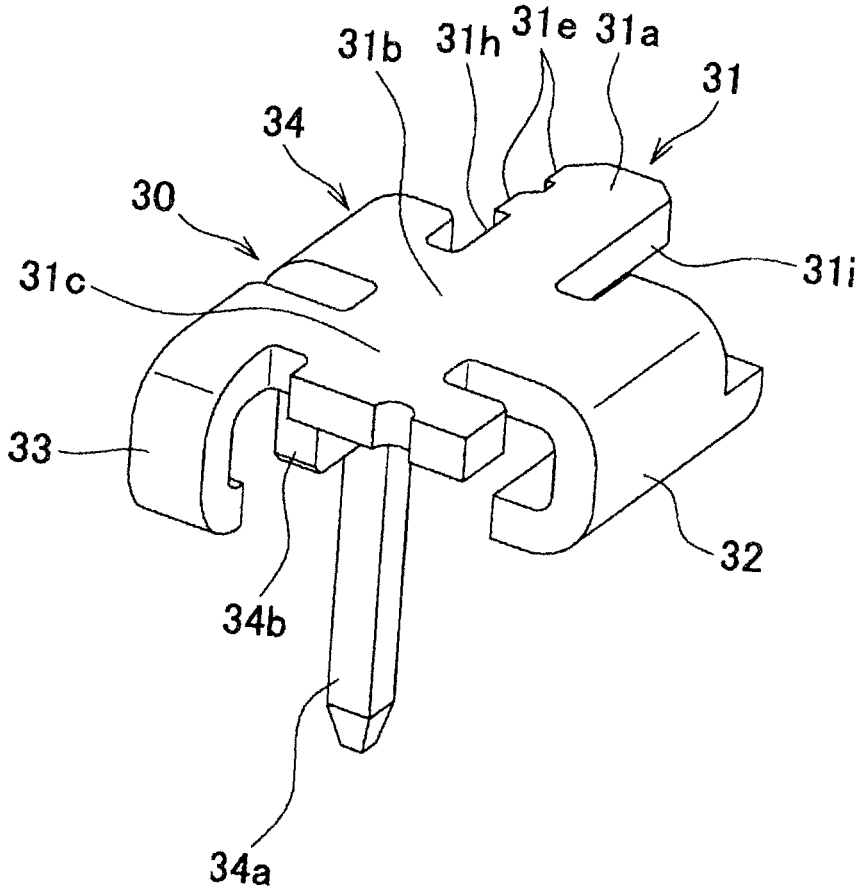
FIG. 4 is a perspective view of a contact of the connector shown in FIG. 2, taken obliquely from above.
Figure 5:
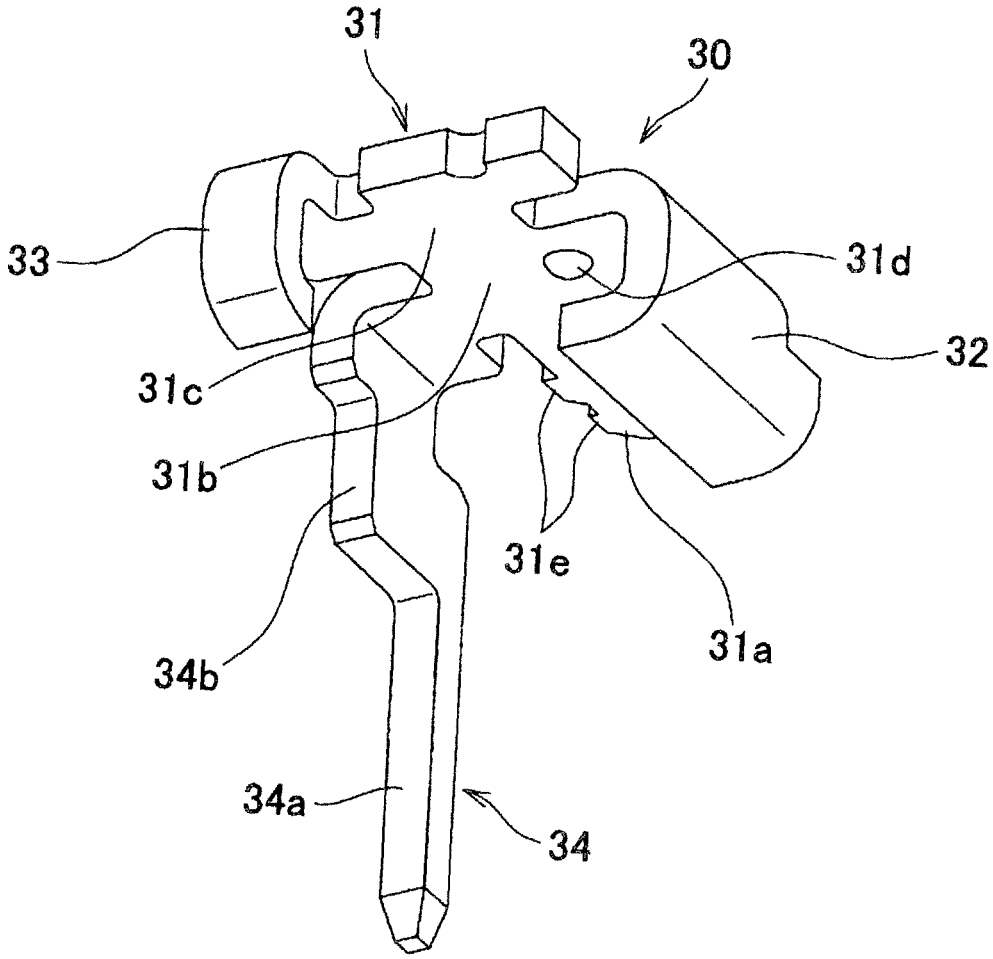
FIG. 5 is a perspective view of the contact shown in FIG. 4, taken obliquely from below.

As shown in FIGS. 4 and 5, each contact 30 includes one holding portion 31, two connection portions 32, 33, and one contact portion 34. The contact 30 is formed by blanking and bending one metal plate.

Figure 6:
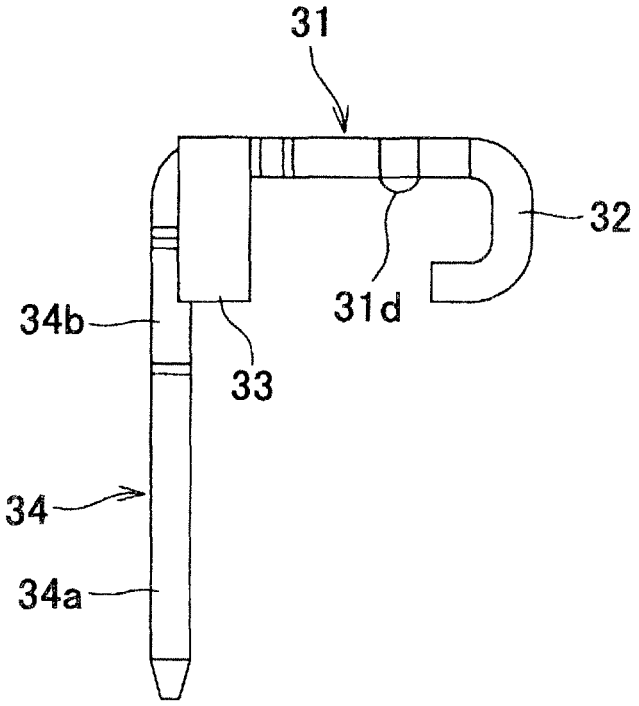
FIG. 6 is a front view of the contact shown in FIG. 4.
Figure 7:
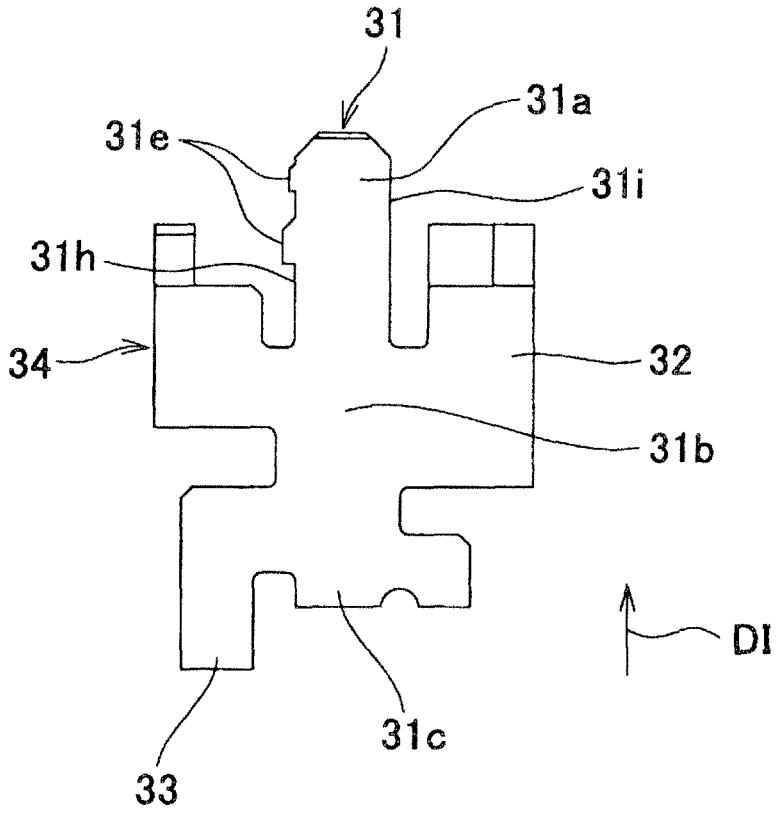
FIG. 7 is a plan view of the contact shown in FIG. 6.
Figure 8:
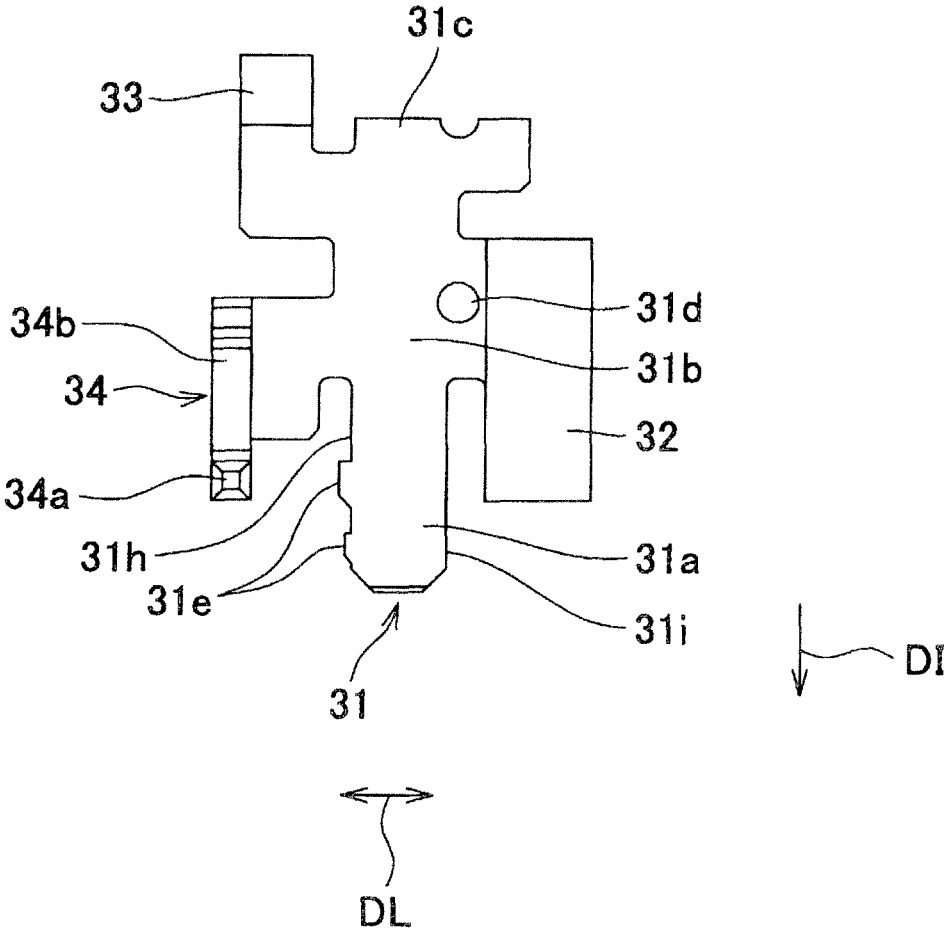
FIG. 8 is a bottom view of the contact shown in FIG. 6.

The holding portion 31 is flat plate-shaped and includes a front end portion 31*a*, a middle portion 31*b*, and a rear end portion 31*c* (see FIGS. 7 and 8). The front end portion 31*a* is continuous with the middle portion 31*b* and the middle portion 31*b* is continuous with the rear end portion 31*c*, along an inserting direction DI, referred to hereinafter (see FIG. 9). In the present embodiment, the thickness direction of the holding portion 31 is the same as both of a connector fitting direction DC1 and the thickness direction of the LED-mounted substrate 81. One side surface 31*h* of the front end portion 31*a* is formed with two protrusions (first protrusion) 31*e*. The middle portion 31*b* is continuous with the front end portion 31*a*. The reverse side of the middle portion 31*b* is formed with a dowel (second protrusion) 31*d* (see FIGS. 5, 6, and 8). The center of the dowel 31*d* is located as shown in FIG. 8, closer to the connection portion 32 than a side surface 31*i* side opposite to the side surface 31*h* on which protrusions portion 31*e* of the front end portion 31*a* are formed, in the longitudinal direction DL of the contact 30. The rear end portion 31*c* is continuous with the middle portion 31*b*.

As shown in FIGS. 2, 6 and 7, the connection portion 32 is continuous with the middle portion 31*b* of the holding portion 31. The connection portion 32 is bent into a substantially U-shape such that a front end thereof extends toward a top plate portion 52. The connection portion 33 is continuous with the rear end portion 31*c* of the holding portion 31. The connection portion 33 bends into a substantially U-shape such that a front end thereof extends toward the top plate portion 52.

Figure 9:
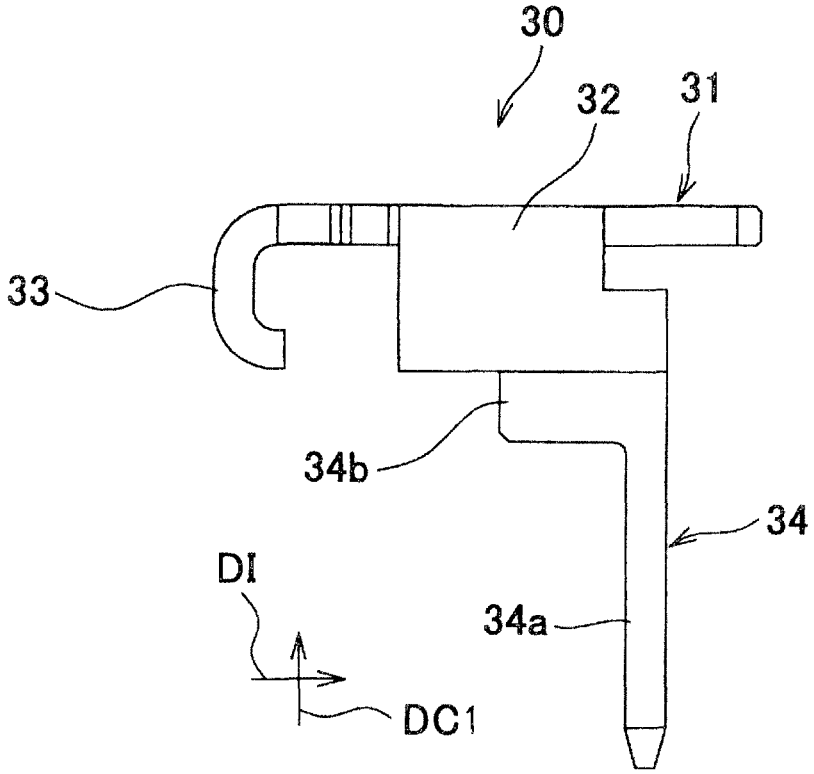
FIG. 9 is a right side view of the contact shown in FIG. 6.
Figure 10:
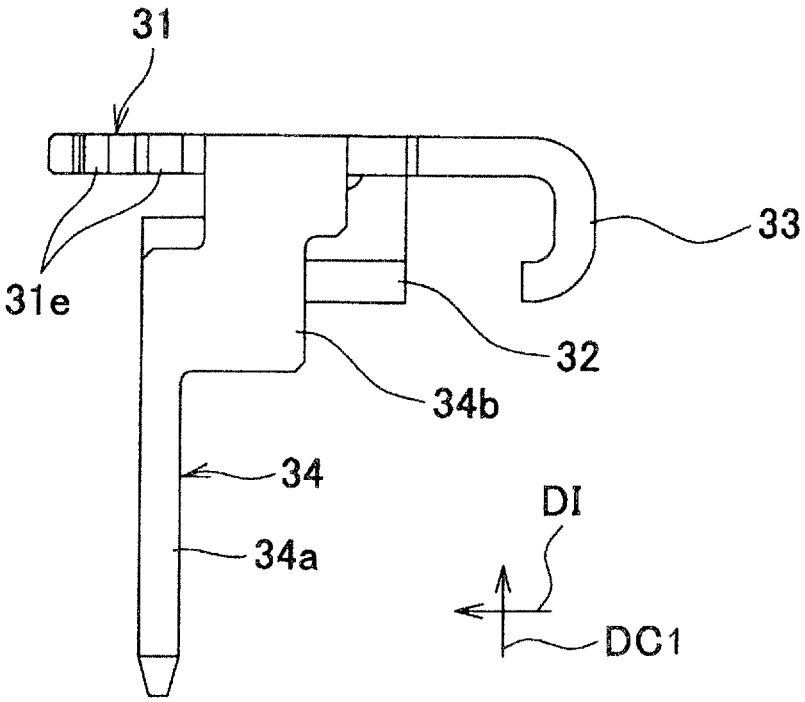
FIG. 10 is a left side view of the contact shown in FIG. 6.

As shown in FIGS. 7, 9 and 10, the contact portion 34 is continuous with the middle portion 31*b* of the holding portion 31, and extends in the connector fitting direction DC1. The contact portion 34 includes a pin-shaped portion 34*a* and a wide portion 34*b*. The pin-shaped portion 34*a* is brought into contact with a contact (not shown) of the cable connector 70. The pin-shaped portion 34*b* is continuous with the wide portion 34*b*. The wide portion 34*b* is continuous with the middle portion 31*b*.

Figure 11:
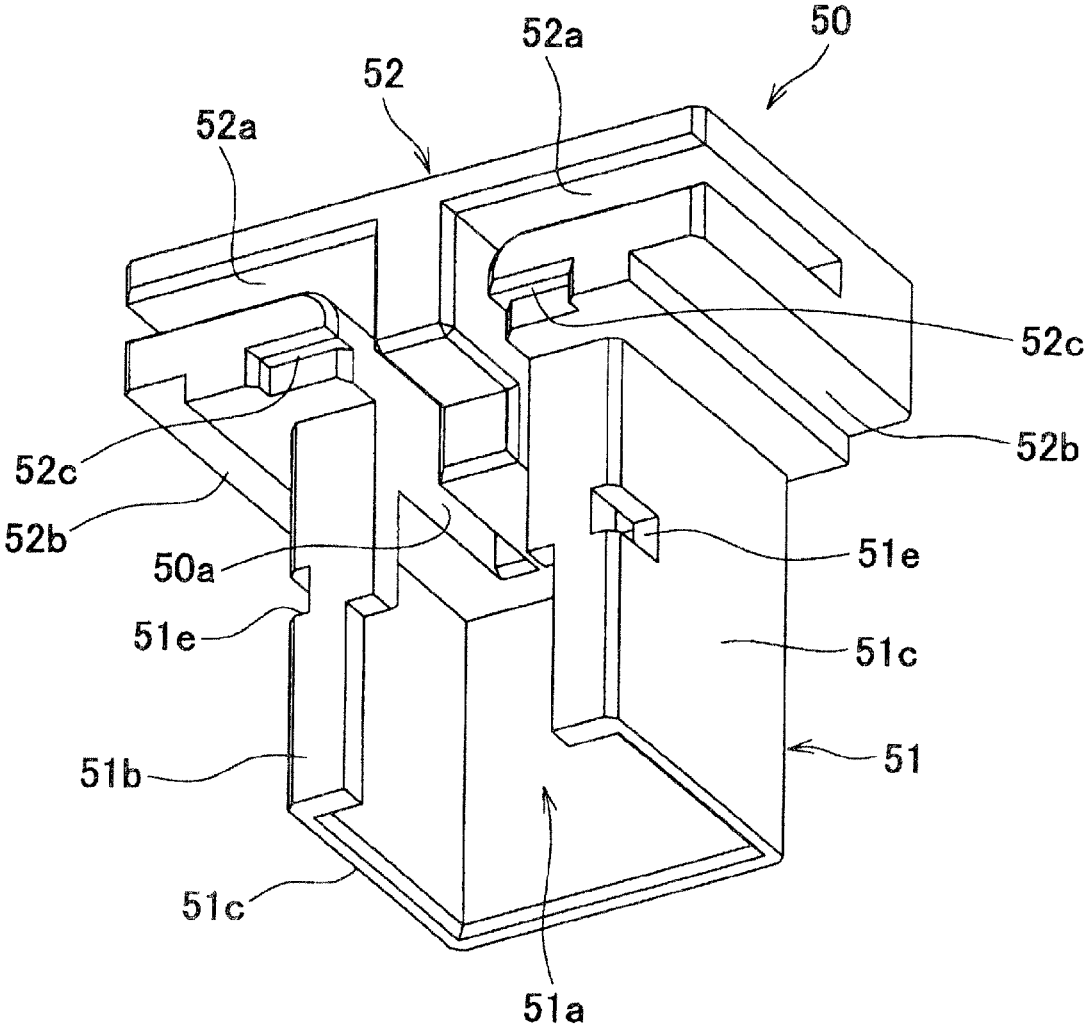
FIG. 11 is a perspective view of a housing of the connector shown in FIG. 2, taken obliquely from below.
Figure 12:
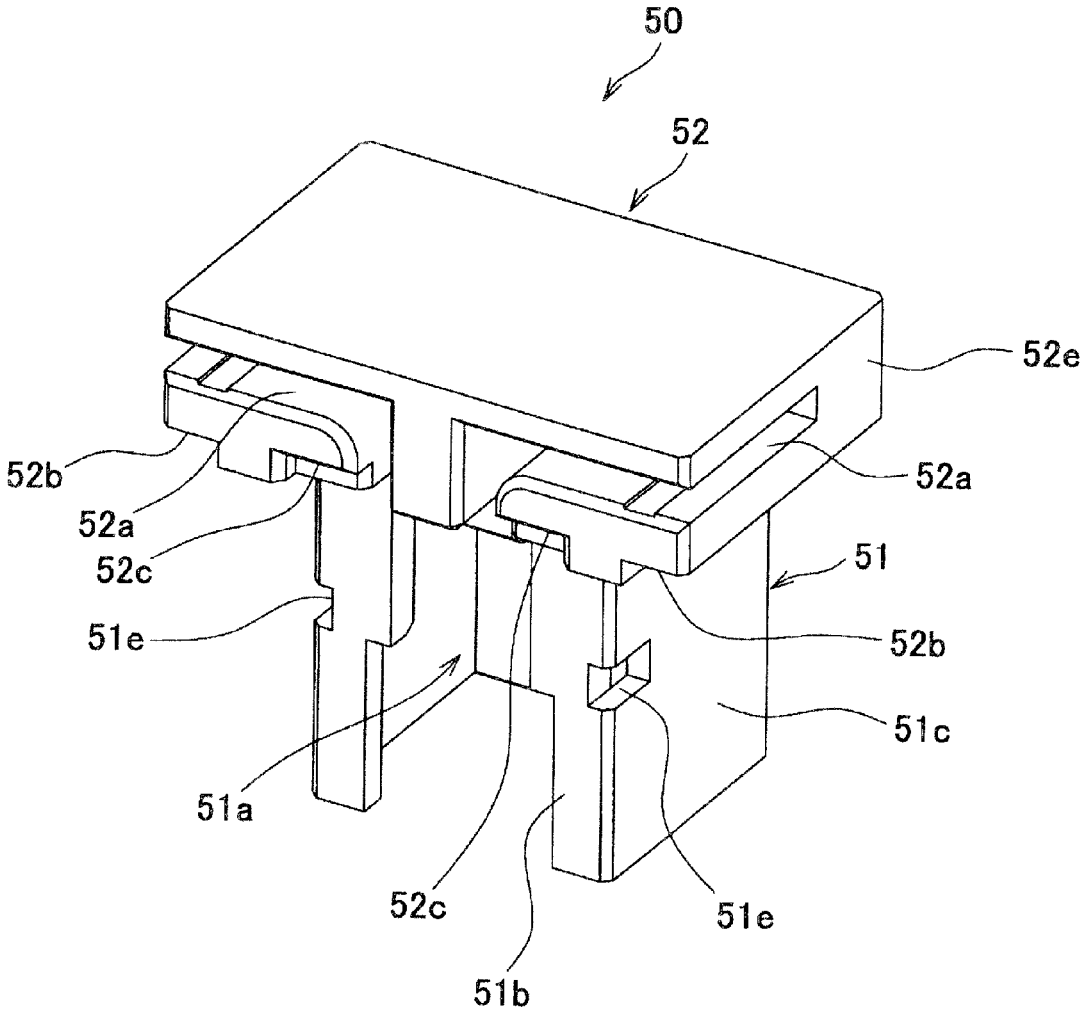
FIG. 12 is a perspective view of the housing of the connector shown in FIG. 11, taken obliquely from above.

As shown in FIGS. 11 and 12, the housing 50 includes a housing main body 51 and the top plate portion 52.

The housing main body 51 is substantially hollow rectangular prism-shaped, and includes a connector receiving portion 51*a* (see FIGS. 2, 12, 13 and 15). The connector receiving portion 51*a* accommodates the contact portions 34 of the contacts 30, and receives a housing (mating housing) 71 (see FIG. 19) of the cable connector 70. The bottom of the housing main body 51 is open, and the connector receiving portion 51*a* communicates with space below the housing main body 51. The connector receiving portion 51*a* is open toward below the housing main body 51. A front portion 51*b* of the housing main body 51 is formed with an opening, and the connector receiving portion 51*a* communicates with space in front of the housing main body 51. Opposite side surface portions 51*c* are each formed with a concave portion 51*e* (see FIGS. 11, 12 and 16). One end of the concave portion 51*e* is open toward the front.

The top plate portion 52 is continuous with the housing main body 51. Although in the present embodiment, the direction along which the housing main body 51 is continuous with the top plate portion 52 is identical to the connector fitting direction DC1, it is not necessarily required that the directions are identical to each other, as described hereinafter. The top plate portion 52 opposes to the mounting surface 81*b* of the LED-mounted substrate 81 (see FIGS. 17 and 18). In the present embodiment, the thickness direction of the top plate portion 52 is identical to both of the connector fitting direction DC1 and the thickness direction of the LED-mounted substrate 81. The top plate portion 52 is formed with two holding portion-receiving portions 52*a*. The inserting direction DI is orthogonal to the direction along which the housing main body 51 is continuous with the top plate portion 52. Each holding portion-receiving portion 52*a* receives the holding portion 31 of the contact 30 from the inserting direction D1. A portion of the holding portion-receiving portion 52*a*, where the front end portion 31*a* of the holding portion 31 is received is formed as a hole 52*h* (see FIG. 13), and encloses four sides of the front end portion 31*a*. Lower surfaces of opposite side portions of the top plate portion 52 are formed with concave portions 52*b*, respectively. Each concave portion 52*b* receives a front end portion of the connection portion 32. Further, a front surface of the top plate portion 52 is formed with two concave portions 52*c*. Each concave portion 52*c* receives a front end portion of the connection portion 33. An upper surface 52*d* of the top plate portion 52 is flat and does not include any slot or the like (see FIG. 14).

Figure 13:
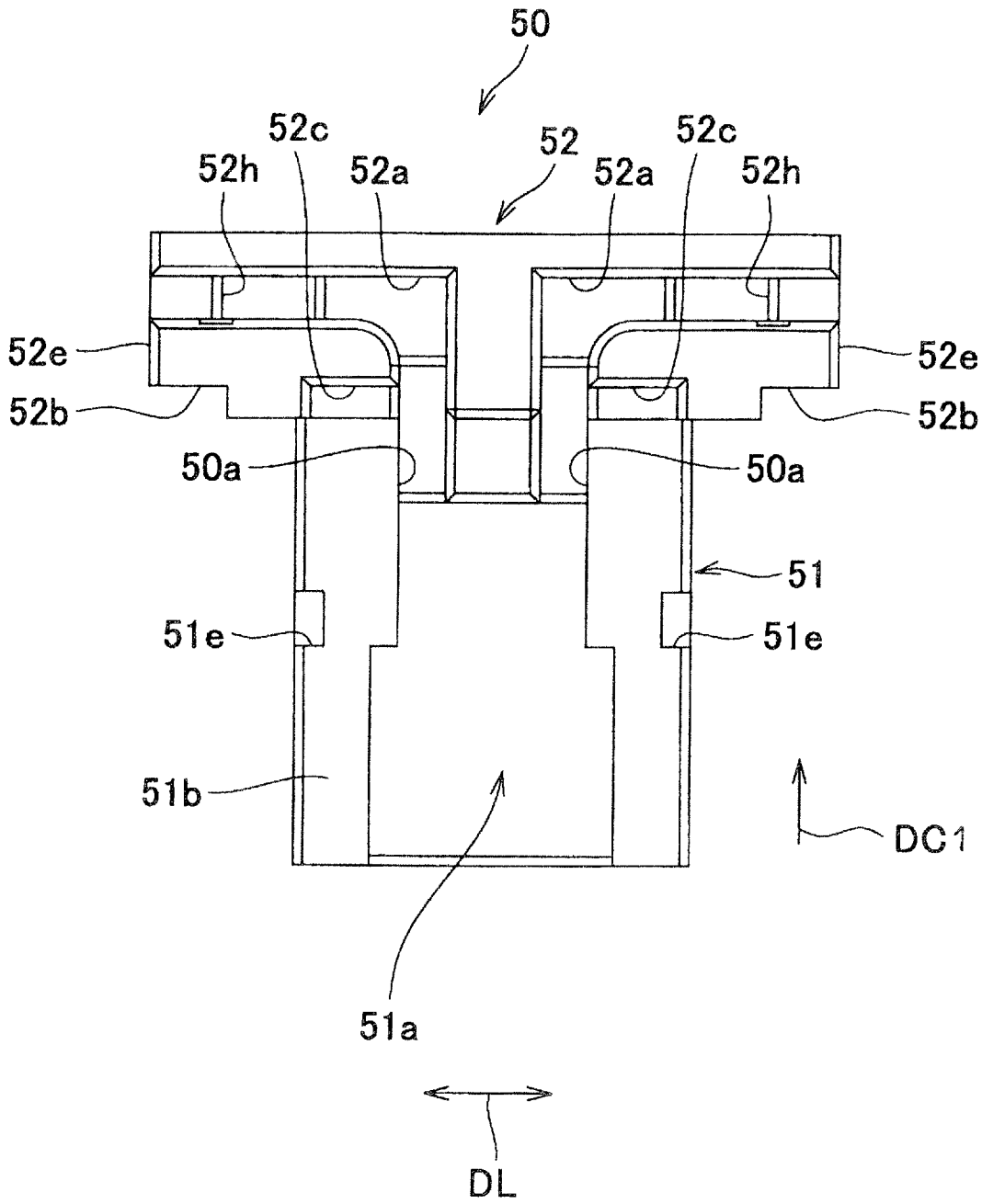
FIG. 13 is a front view of the housing shown in FIG. 11.
Figure 14:
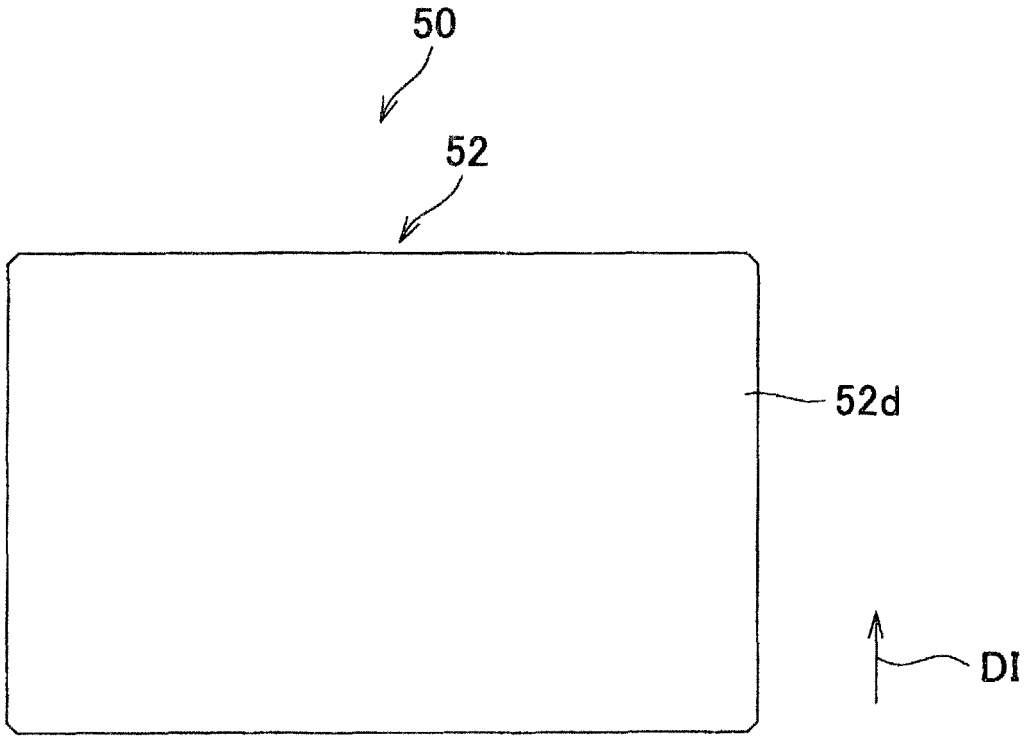
FIG. 14 is a plan view of the housing shown in FIG. 13.
Figure 15:
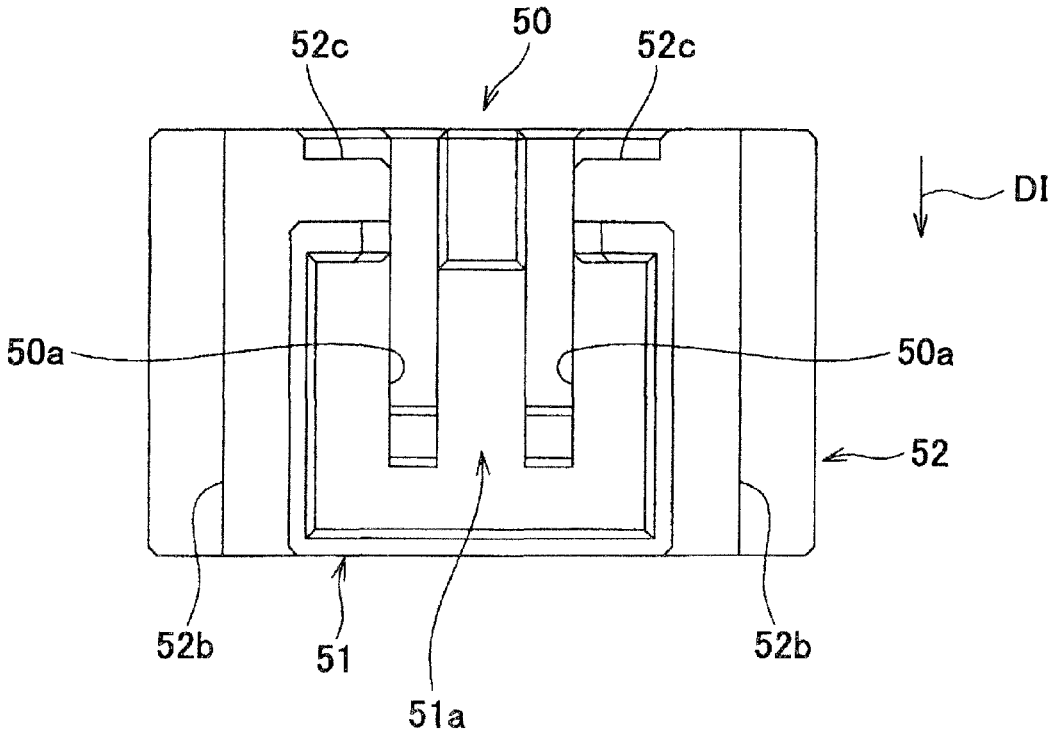
FIG. 15 is a bottom view of the housing shown in FIG. 13.
Figure 16:
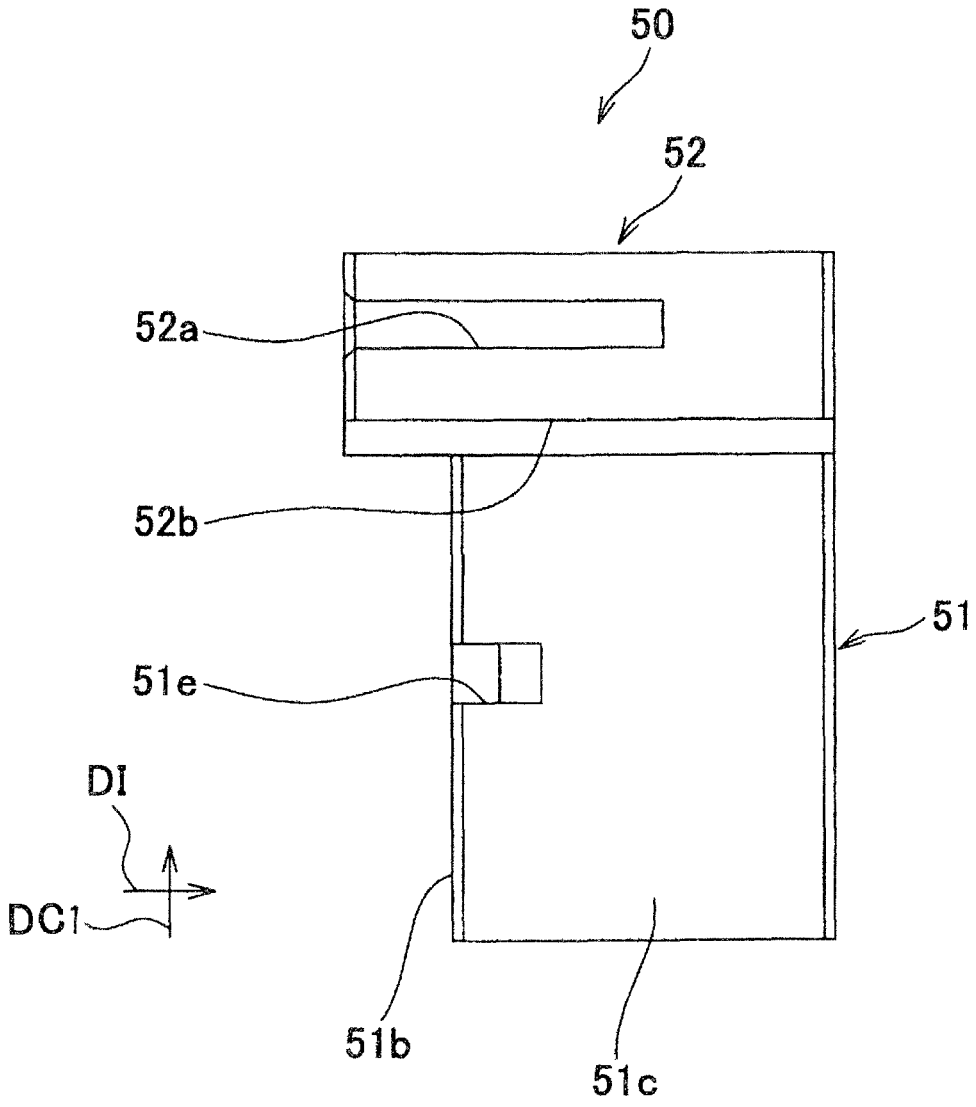
FIG. 16 is a right side view of the housing shown in FIG. 13.

From the top plate portion 52 to the housing main body 51, two slots 50*a* are formed (see FIGS. 13 and 15). Each slot 50*a* receives the wide portion 34*b* of the contact portion 34 of the contact 30. The holding portion-receiving portion 52*a* communicates with the connector receiving portion 51*a* via the slot 50*a*. The wide portion 34*b* and the slot 50*a* restricts swing of the pin-shaped portion 34*a* of the contact 30 in the longitudinal direction DL (see FIGS. 8 and 13).

To assemble the contact 30 to the housing 50, it is required to insert the holding portion 31 of the contact 30 to the holding portion-receiving portion 52*a* of the top plate portion 52, from front of the housing 50, along the inserting direction DI.

When the holding portion 31 of the contact 30 is inserted into the holding portion-receiving portion 52*a* of the top plate portion 52, the protrusion 31*e* of the front end portion 31*a* of the holding portion 31 is brought into strong contact with inner wall surfaces (vertical surfaces) of the hole 52*h*, and the contact 30 is pushed toward a side surface 52*e* (see FIG. 13) of the top plate portion 52, and is held. The side surface 31*i* of the front end portion 31*a* is formed into a sloped surface (so-called rollover is formed) at the time of being blanked, and hence when the side surface 31*i* is pushed against the inner wall surface (vertical surfaces) of the hole 52*h* of the top plate portion 52, the holding portion 31 is about to pivot with a lower end of the side surface 31*i* in the center such that the front end portion 31*a* is inclined with respect to an inner wall surface (horizontal surface) of the hole 52*h*. However, the contact 30 has the dowel 31*d* located closer in the longitudinal direction DL to the connection portion 32 than the side surface 31*i* is (see FIG. 8), and the dowel 31*d* pushes the holding portion 31 toward the inner wall surface (horizontal surface) of the hole 52*h*. This blocks the front end portion 31*a* from pivoting, whereby the holding portion 31 is inserted into the holding portion-receiving portion 52*a* in a state parallel to the LED-mounted substrate 81, and is held.

Figure 17:
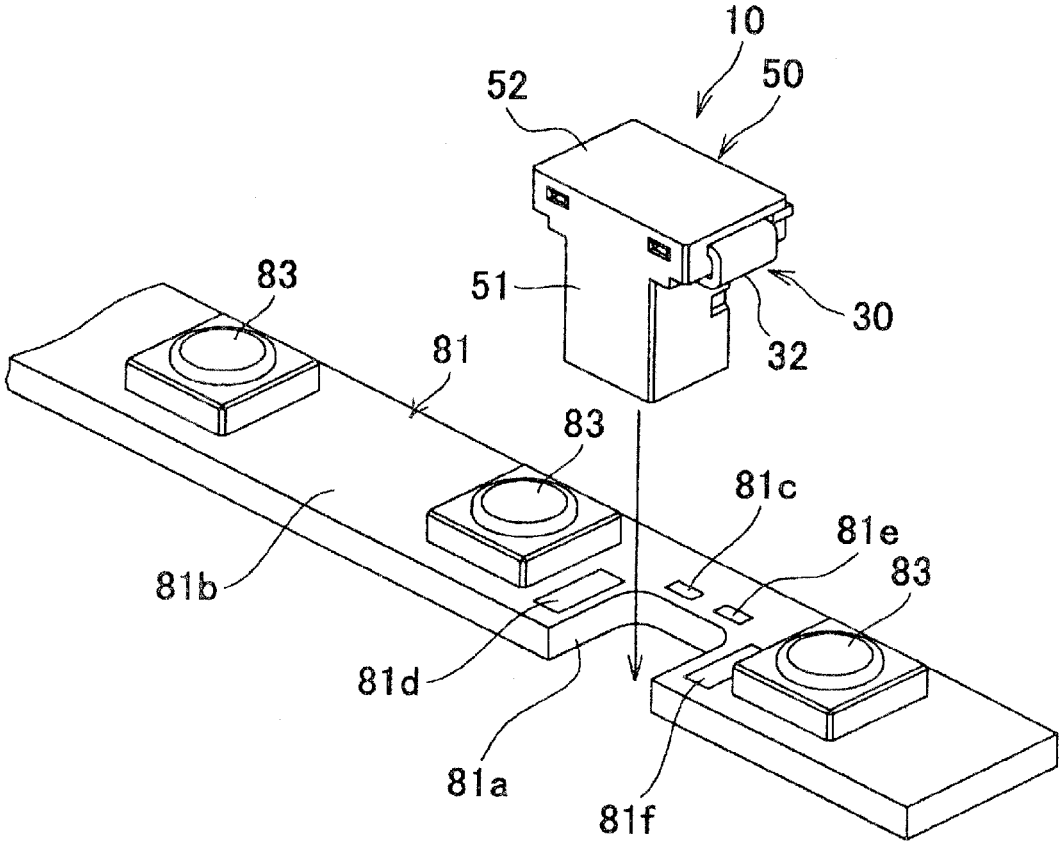
FIG. 17 is a perspective view of the connector in a state before being mounted on an LED-mounted substrate.

To mount the connector 10 on the LED-mounted substrate 81, first, the housing main body 51 of housing 50 of the connector 10 is inserted into a cutout (inserted portion) 81*a* of the LED-mounted substrate 81, as shown in FIG. 17. At this time, the connection portion 32 and the connection portion 33 of one contact 30 of the connector 10 are disposed on a land 81*d* and a land 81*c*, respectively, and the connection portion 32 and the connection portion 33 of the other contact 30 of the connector 10 are disposed on a land 81*f* and a land 81*e*, respectively.

Thereafter, the connection portions 32 and 33 of the one contact 30 are soldered to the lands 81*d* and 81*c*, respectively, and the connection portions 32 and 33 of the other contact 30 are soldered to the lands 81*f* and 81*e*, respectively.

By undergoing the above processing steps, the connector 10 is mounted on the LED-mounted substrate 81.

Figure 18:
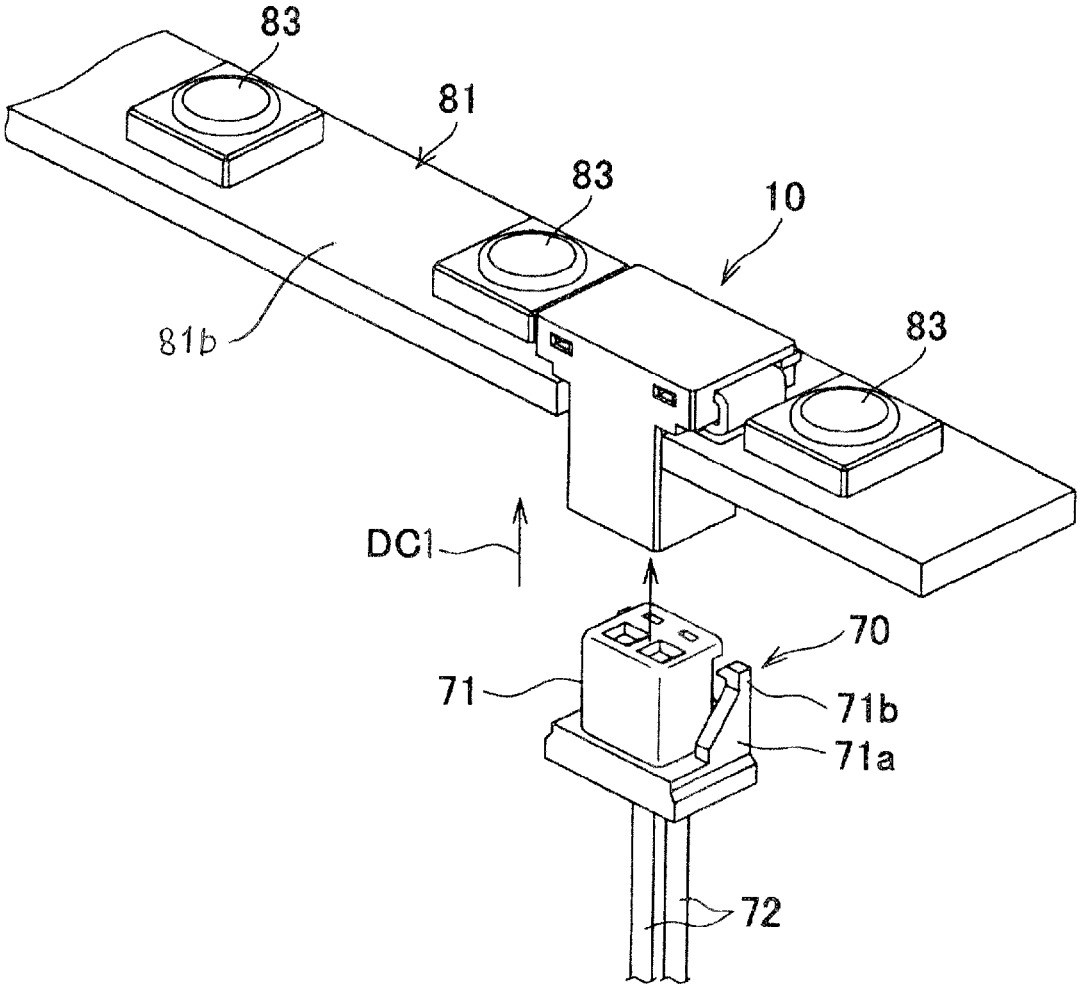
FIG. 18 is a perspective view of the connector, which is mounted on the LED-mounted substrate, in a state before being connected to a cable connector.
Figure 19:
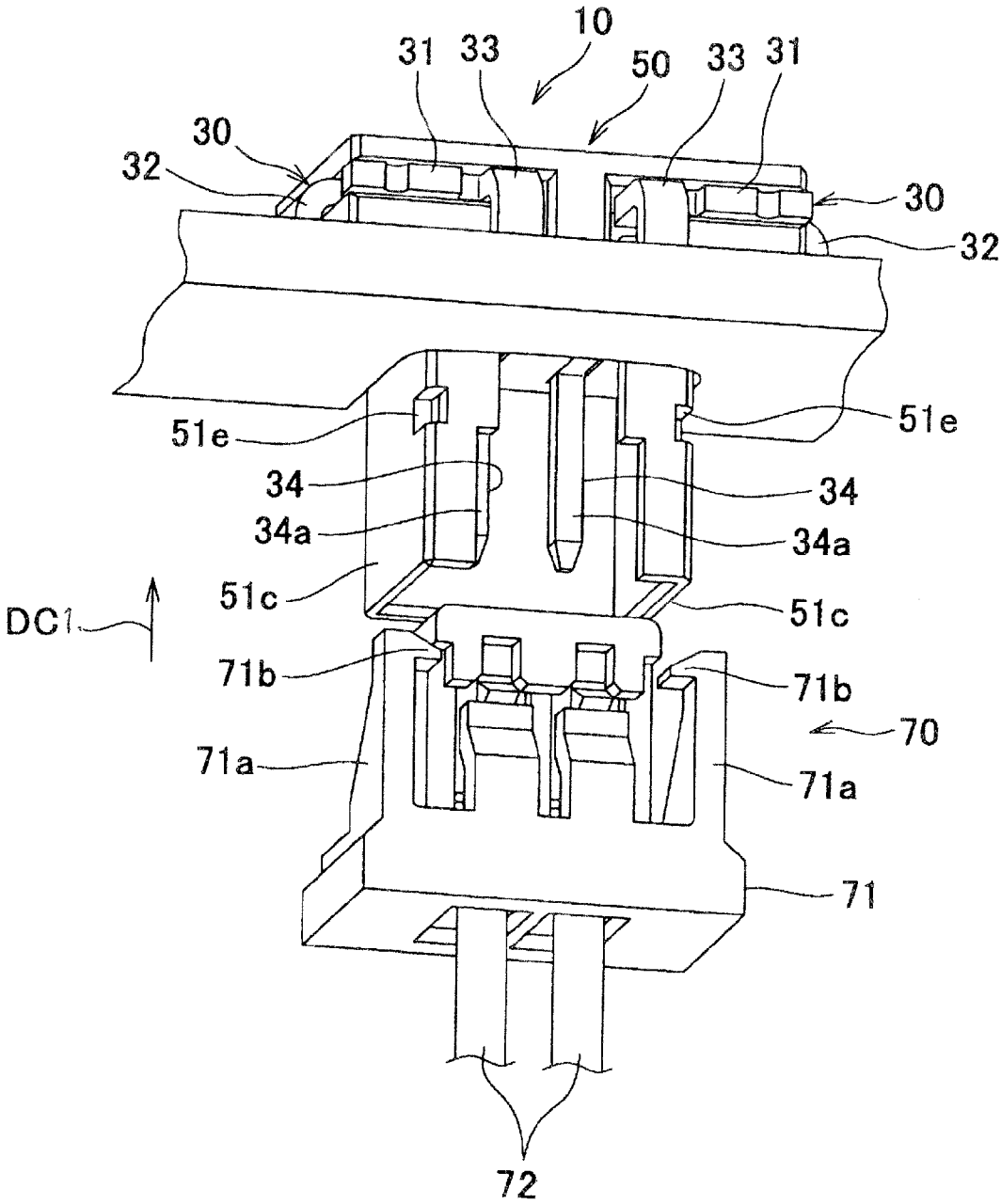
FIG. 19 is a perspective view of the connector shown in FIG. 18, taken obliquely from below.
Figure 20:
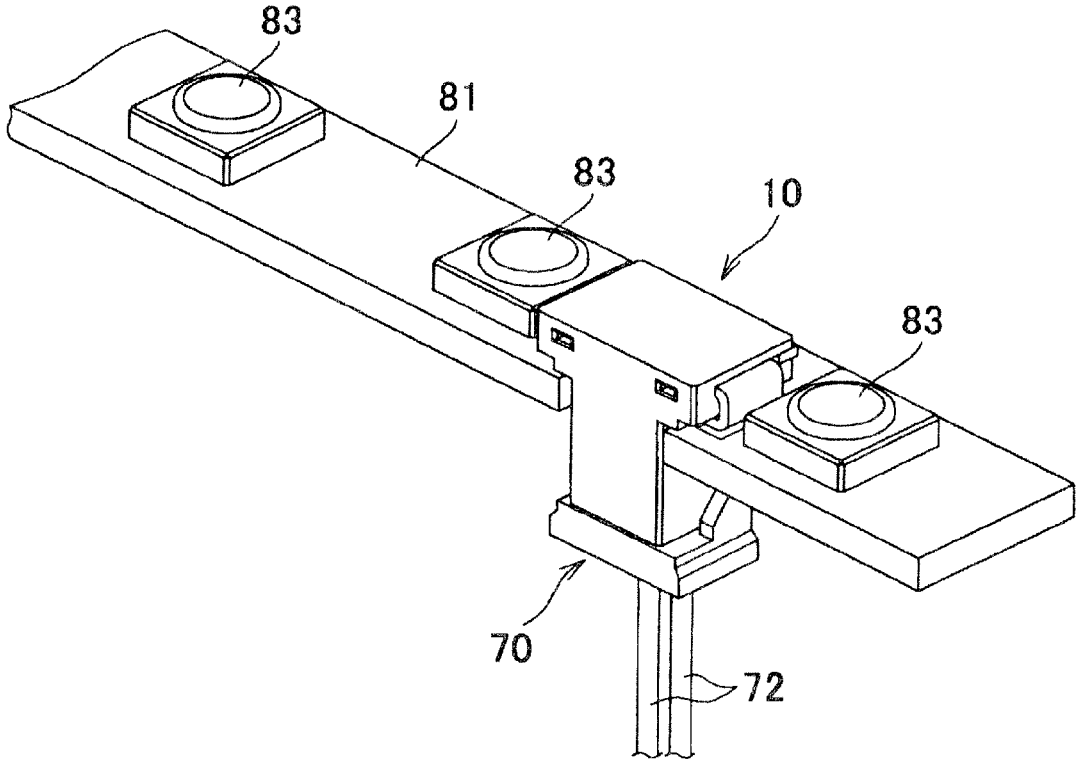
FIG. 20 is a perspective view of the connector, which is mounted on the LED-mounted substrate, in a state connected to the cable connector.
Figure 21:
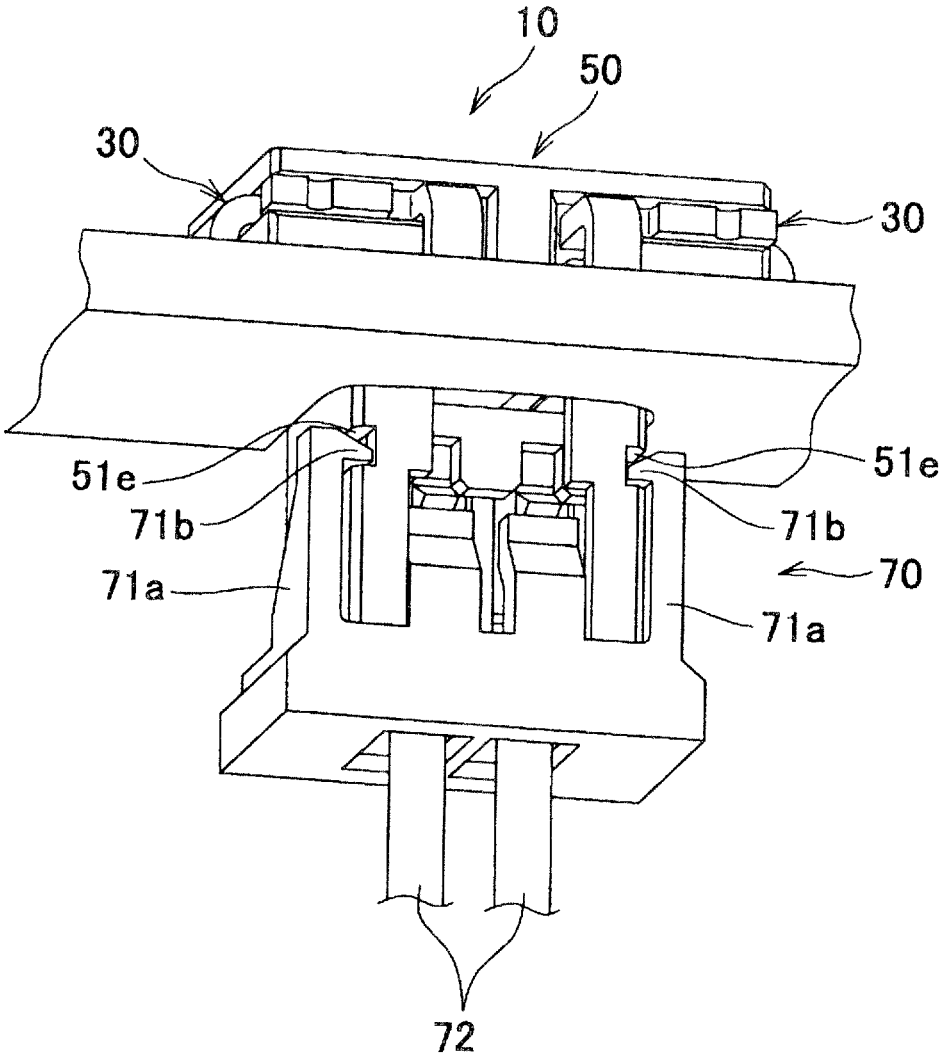
FIG. 21 is a perspective view of the connector shown in FIG. 20, taken obliquely from below.

To connect the cable connector 70 to the connector 10, the cable connector 70 is fitted to the connector 10, from below the connector 10, along the connector fitting direction DC1, as shown in FIGS. 18 and 19.

The distance between nails 71*b* and 71*b* which are formed respectively on two locking portions 71*a* and 71*a* (see FIG. 19) of the housing 71 of the cable connector 70 is configured to be narrower than the distance between the opposite side surface portions 51*c* and 51*c* of the housing 50. Therefore, when fitting the cable connector 70 to the connector 10, the nails 71*b* and 71*b* move on the opposite surface portions 51*c* and 51*c*, and when the nails 71*b* and 71*b* reach the concave portions 51*e* and 51*e*, the nails 71*b* and 71*b* enter the concave portions 51*e* and 51*e* by the elastic forces of the locking portions 71*a* and 71*a*. At this time, a click is produced, which makes it possible to perceive that the cable connector 70 has been properly fitted to the connector 10. Therefore, if a connection work of the connector 10 and the cable connector 70 is done while paying attention to a click to be produced when the nails 71*b* and 71*b* are fitted to the concave portions 51*e* and 51*e*, it is possible to know that the cable connector 70 has been positively electrically connected to the connector 10.

According to the first embodiment, since the holding portion-receiving portion 52*a* of the top plate portion 52 of the housing 50 receives the holding portion 31 of the contact 30, from the inserting direction DI which is orthogonal to the direction along which the housing main body 51 is continuous with the top plate portion 52, it is possible to reduce a height dimension of the top plate portion 52 and reduce a dimension of the connector 10 in the fitting direction DC1.

Further, since the height dimension of the top plate portion 52 can be reduced, the amount of protrusion of the connector 10 from the mounting surface 81*b* of the LED-mounted substrate 81 can be reduced, whereby the amount of light from the LED 83 which is blocked by the connector 10 is reduced.

Furthermore, since the inserting direction DI of the contact 30 is orthogonal to the direction along which the housing main body 51 is continuous with the top plate portion 52, it becomes unnecessary to form a slot, a cutout or the like, which is open in the upper surface 52*d* of the top plate portion 52. This makes it possible to prevent unevenness from being produced in the brightness of a light-guiding plate (not shown) for backlight when the LED 83 is lit. Further, since the upper surface 52*d* of the top plate portion 52 is provided as a broad and flat area without any slot or cutout, a mounter (automatic mounting device), not shown, can positively easily attract the upper surface 52*d* of the top plate portion 52 by a suction nozzle thereof.

Furthermore, the connection portions 32 and 33 of the contact 30 are bent into a substantially U-shape, with the front ends of the connection portions 32 and 33 facing toward the housing 50, and the connection portions 32 and 33 of the contact 10 do not protrude in the direction orthogonal to the thickness direction of the top plate portion 52. Therefore, it is possible to reduce a mounting area or mounting space necessary for mounting the connector 10 on the LED-mounted substrate 81. Further, the connection portions 32 and 33 are bent into a substantially U-shape, and the surfaces of the front end portions (surfaces each orthogonal to a cut surface formed by blanking) thereof are soldered to the lands 81*d*, 81*c*, 81*f*, and 81*e*. Therefore, it is possible to increase soldering areas of the connection portions 32 and 33 soldered to the lands 81*d*, 81*c*, 81*f*, and 81*e*, whereby soldering strength of the connection portions 32 and 33 is higher than the conventional connector in which the soldering surface of a mounting portion of a connector is a cut surface formed by blanking, and hence there is little fear of the connection portions 32 and 33 coming off from the lands 81*d*, 81*c*, 81*f*, and 81*e*.

Further, since the contact 30 has the dowel 31*d*, when the contact 30 is inserted into the housing 50, it is possible to suppress the holding portion 31 from being inclined with respect to the mounting surface 81*b* of the LED-mounted substrate 81. Further, since the holding portion 31 is strongly pushed against the inner wall surface of the holding portion-receiving portion 52*a* by the dowel 31*d*, the holding portion 31 is made hard to swing. This makes it possible to suppress the swing of the contact portion 34. Further, since the contact portion 34 is hard to swing, it is possible to prevent such accidents as the contact portion 34 failing to contact the mating contact (not shown) due to fitting of the connector 10 to the cable connector 70 in an inclined state of the contact portion 34, and the contact portion 34 being bent by the mating contact.

Furthermore, since the two contacts 30 each have two connection portions 32 and 33, one connector 10 has four connection portions 32 and 33. Even if one of the connection portions 32 and 33 is disconnected from the LED-mounted substrate 81, the connector 10 does not become shaky, and can continue to supply power to the LEDs 83. Further, since the two contacts 30 each have two connection portions 32 and 33, hold-down (not shown) can be omitted.

Further, since the holding portion-receiving portion 52*a* of the top plate portion 52 of the housing 50 receives the holding portion 31 of the contact 30, from the inserting direction DI orthogonal to the direction along which the housing main body 51 is continuous with the top plate portion 52, when connecting the cable connector 70 to the connector 10, even if the housing 50 of the connector 10 is pushed upward along the connector fitting direction DC1 by the cable connector 70, there is little fear of the contact 30 being removed from the housing 50.

Figure 22:
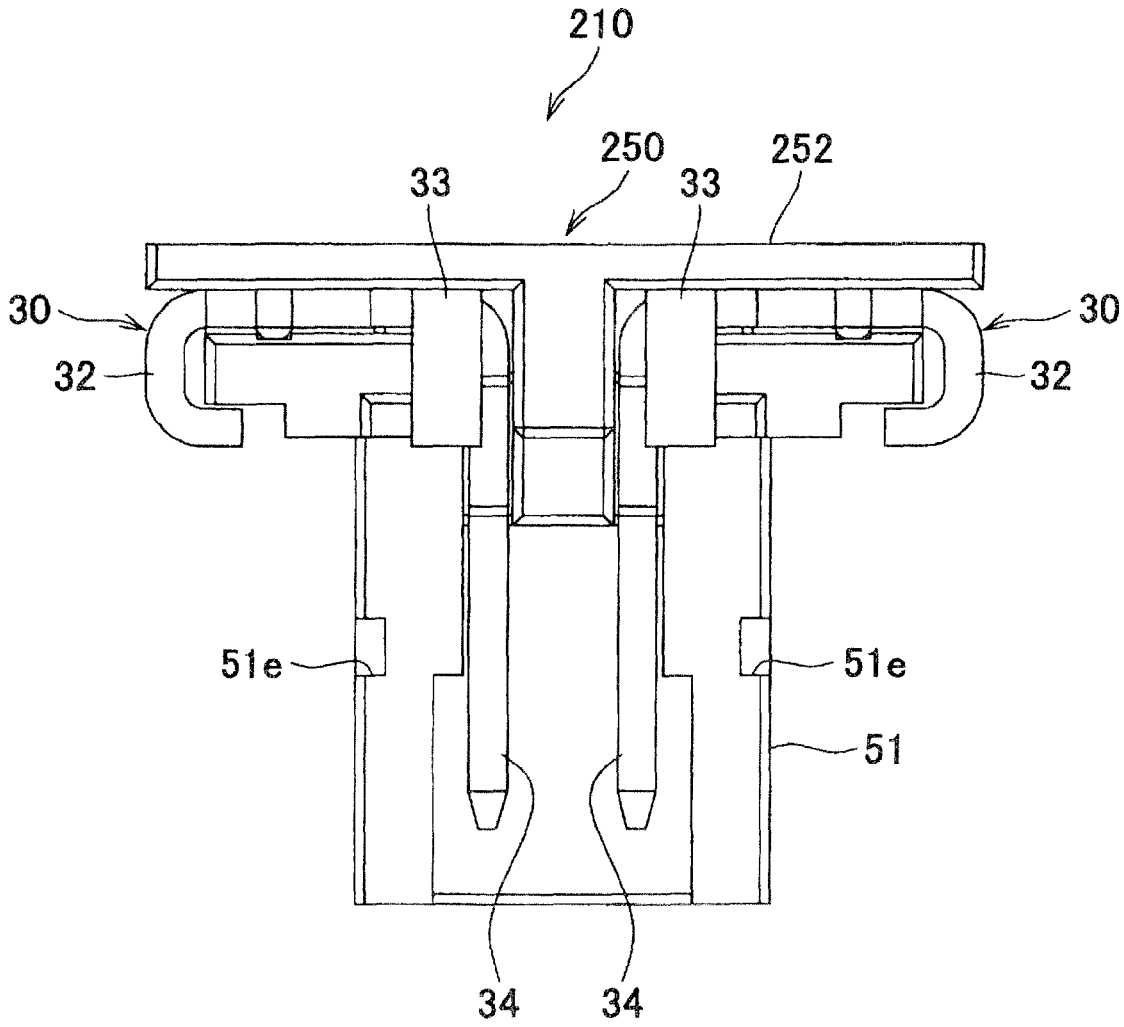
FIG. 22 is a front view of a variation of the connector according to the first embodiment of the present invention.

Next, a description will be given of a variation of the connector according to the above-described first embodiment of the present invention with reference to FIGS. 22 to 24. Components common to the above-mentioned embodiment are denoted by the same reference numerals, and detailed description thereof is omitted.

In the first embodiment, when the top plate portion 52 is viewed from substantially directly above, the contact 30 almost in its entirety is covered by the top plate portion 52, and part of the connection portions 32 and 33 is exposed.

Figure 23:
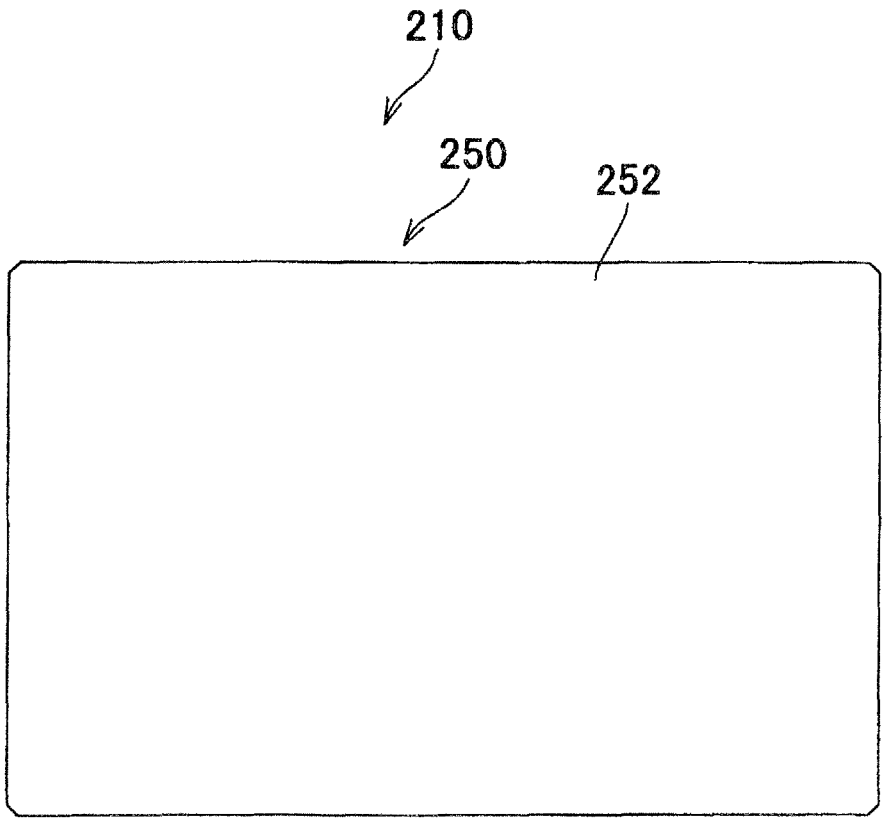
FIG. 23 is an plan view of the connector shown in FIG. 22.
Figure 24:
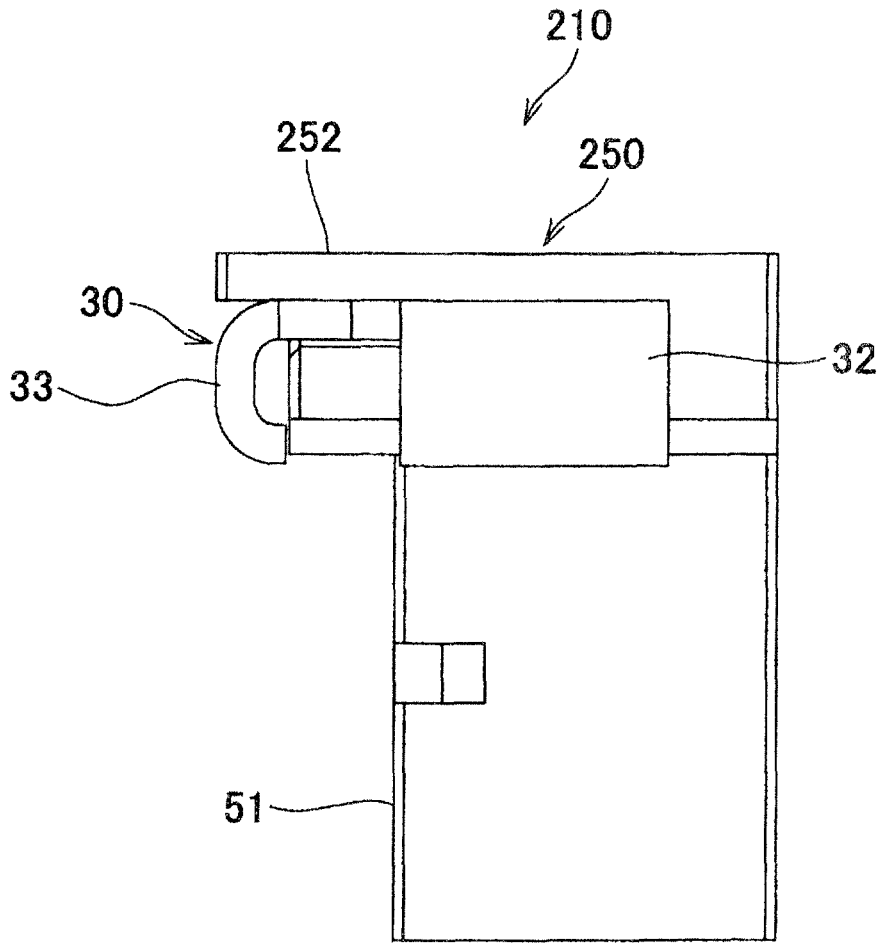
FIG. 24 is a right side view of the connector shown in FIG. 22.

In contrast, in this variation, when a top plate portion 252 of a housing 250 of a connector 210 is viewed from substantially directly above, the contact 30 in its entirety is covered by the top plate portion 252, and part of the connection portion 32 and 33 is not exposed as shown in FIG. 23.

According to this variation, it is possible to obtain advantageous effects as provided by the first embodiment, and when the top plate portion 252 is viewed from substantially directly above, the contact 30 in its entirety is covered by the top plate portion 252, which makes it possible to suppress light from the LEDs 83 from being reflected.

Next, a description will be given of a connector according to a second embodiment of the present invention with reference to FIGS. 25 to 40. Components common to the first embodiment are denoted by the same reference numerals, and detailed description thereof is omitted.

Figure 25:
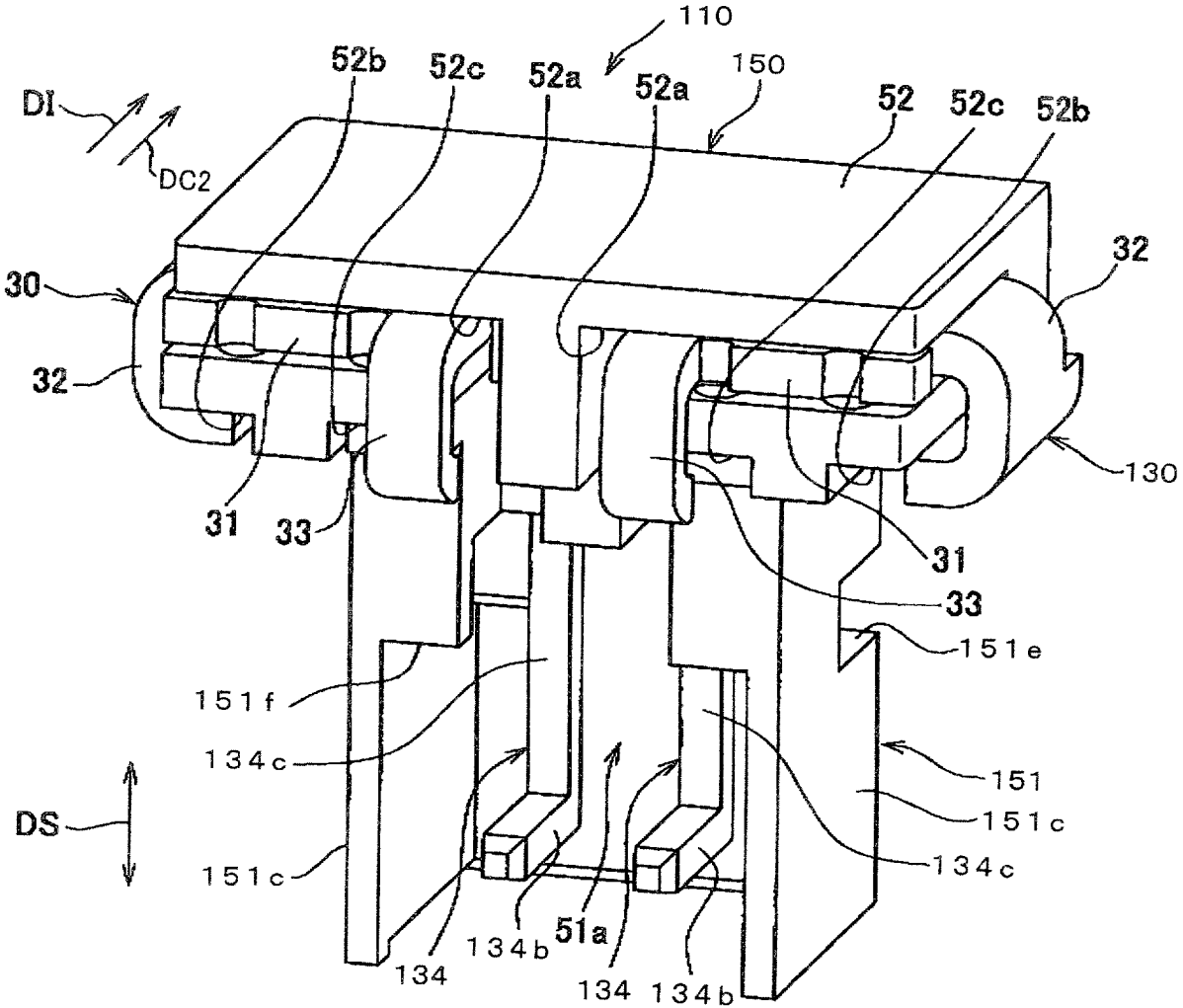
FIG. 25 is a perspective view of a connector according to a second embodiment of the present invention.
Figure 26:
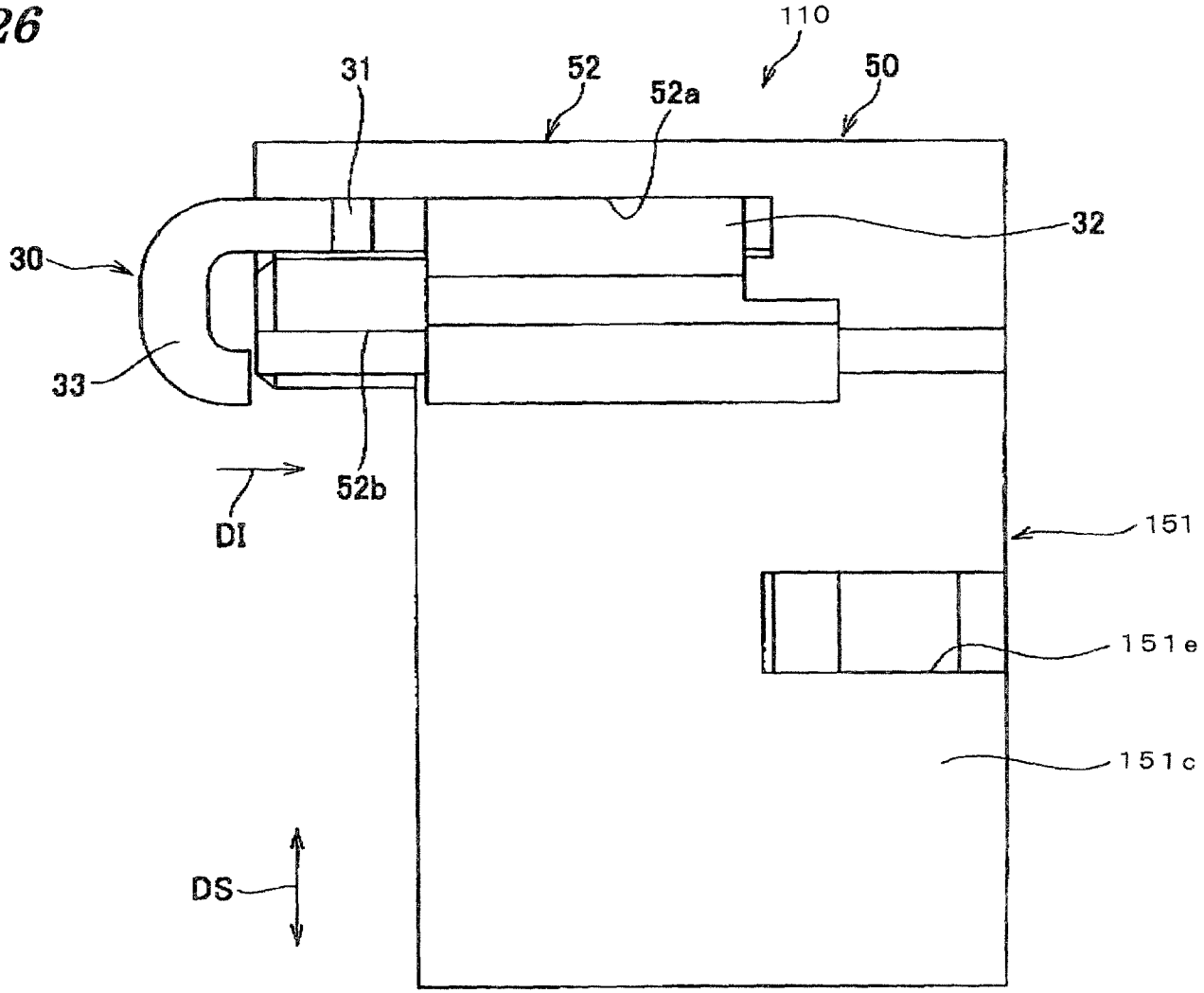
FIG. 26 is a side view of the connector shown in FIG. 25.

As shown in FIGS. 25 and 26, a connector 110 comprises two contacts 130 and one housing 150.

Figure 27:
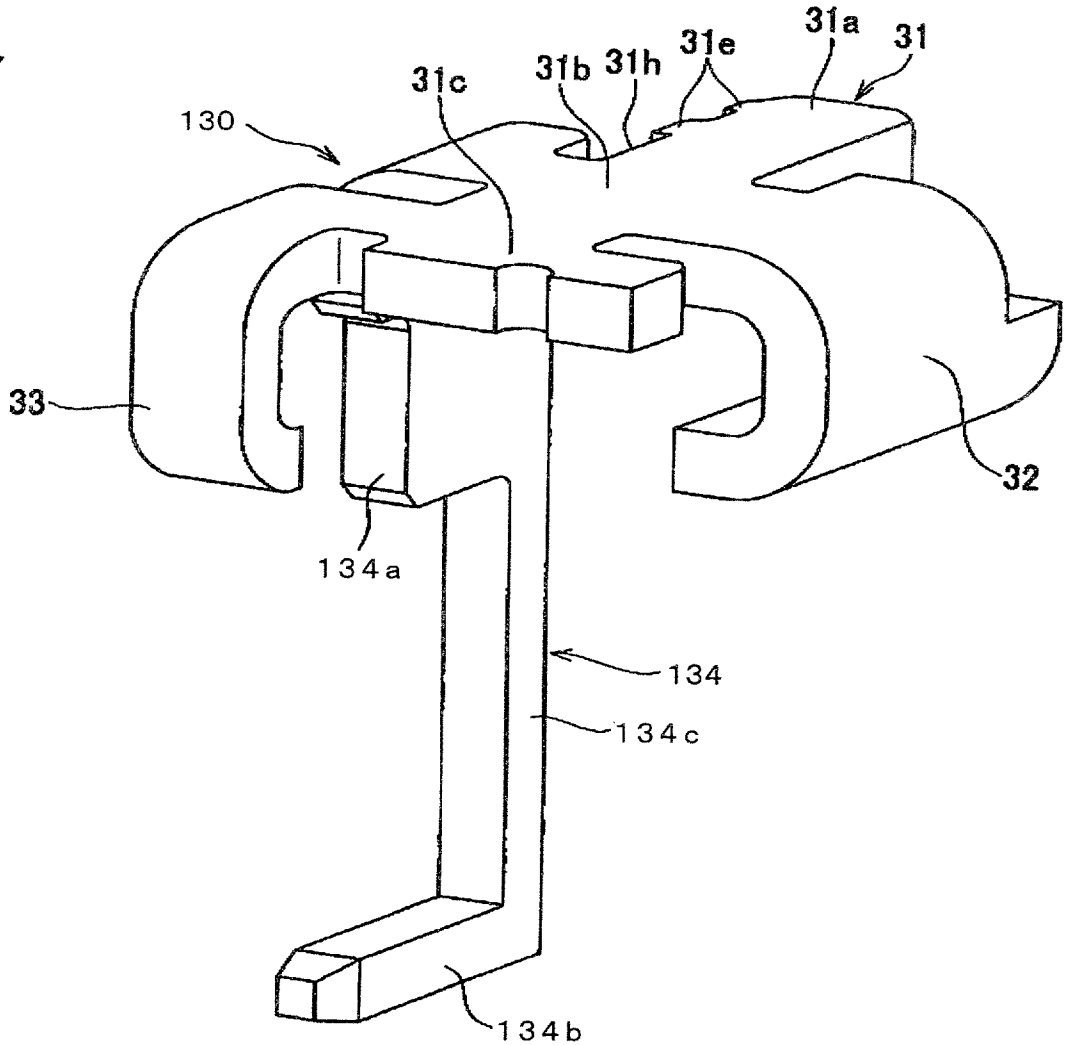
FIG. 27 is a perspective view of a contact of the connector shown in FIG. 25, taken obliquely from above.

As shown in FIG. 27, each contact 130 includes the one holding portion 31, the two connection portions 32 and 33, and one contact portion 134. The contact 130 is formed by blanking and bending one metal plate.

The holding portion 31 is flat plate-shaped, and includes the front end portion 31*a*, the middle portion 31*b*, and the rear end portion 31*c*. The front end portion 31*a* is continuous with the middle portion 31*b* and the middle portion 31*b* is continuous with the rear end portion 31*c*, along the inserting direction DI (see FIG. 25). In the present embodiment, the thickness direction of the holding portion 31 is identical to both of a direction DS (see FIG. 25) along which a housing main body 151 is continuous with the top plate portion 52 and the thickness direction of the LED-mounted substrate 81. One side surface 31*h* of the front end portion 31*a* is formed with the two protrusions 31*e*. The middle portion 31*b* is continuous with the front end portion 31*a*. The reverse side of the middle portion 31*b* is formed with a dowel (not shown). The rear end portion 31*c* is continuous with the middle portion 31*b*.

As shown in FIGS. 27 and 25, the contact portion 134 includes a wide portion 134*a*, a contacting portion 134*b*, and a connection portion 134*c*. The wide portion 134*a* is continuous with the middle portion 31*b* of the holding portion 31. The contacting portion 134*b* extends in a connector fitting direction DC2 (see FIG. 25). The connector fitting direction DC2 is orthogonal to the direction DS along which the housing main body 151 is continuous with the top plate portion 52. The contacting portion 134*b* is brought into contact with a contact (not shown) of the cable connector 70. The connection portion 134*c* extends in the direction DS along which the housing main body 151 is continuous with the top plate portion 52, and links between the wide portion 134*a* and the contacting portion 134*b*.

Figure 28:
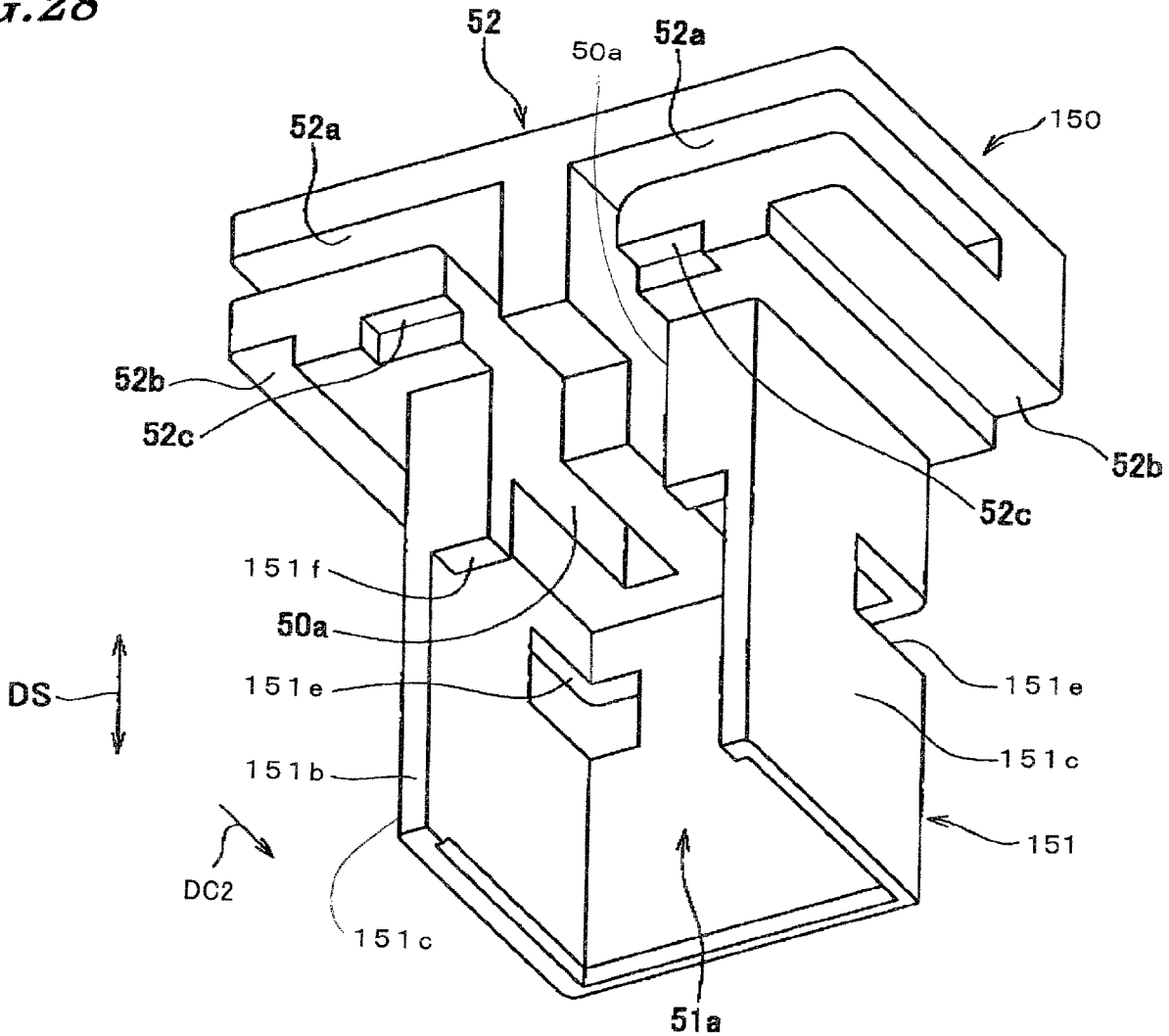
FIG. 28 is a perspective view of a housing of the connector shown in FIG. 25, taken obliquely from below.
Figure 29:
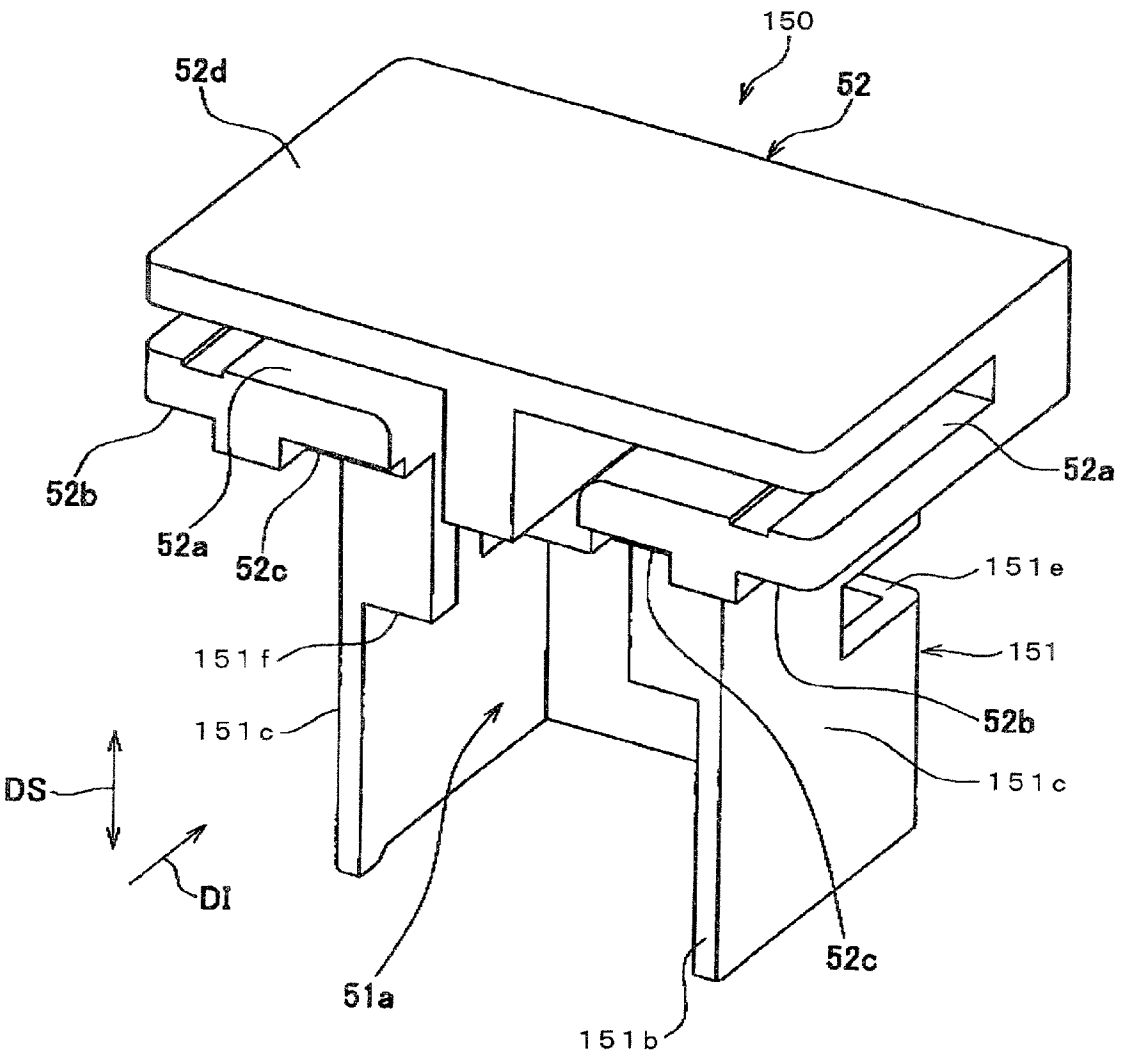
FIG. 29 is a perspective view of the housing shown in FIG. 28, taken obliquely from above.

As shown in FIGS. 28 and 29, the housing 150 includes the housing main body 151 and the top plate portion 52.

The housing main body 151 is substantially hollow rectangular prism-shaped, and includes the connector receiving portion 51*a*. A front portion 151*b* of the housing main body 151 is formed with an opening 151*f*, the connector receiving portion 51*a* communicates with space in front of the housing main body 151. The bottom surface of the housing main body 151 is open, and the connector receiving portion 51*a* communicates with space below the housing main body 151. The connector receiving portion 51*a* accommodates the contact portion 134 of the contact 130, and receives the housing (mating housing) 71 (see FIGS. 32 and 33) of the cable connector 70, from the connector fitting direction DC2 (from the front-rear direction of the housing 5). Opposite surface portions 151*c* of the housing main body 151 are formed with respective holes 151*e*. The holes 151*e* are located at the rear end portion of the housing main body 151.

Figure 30:
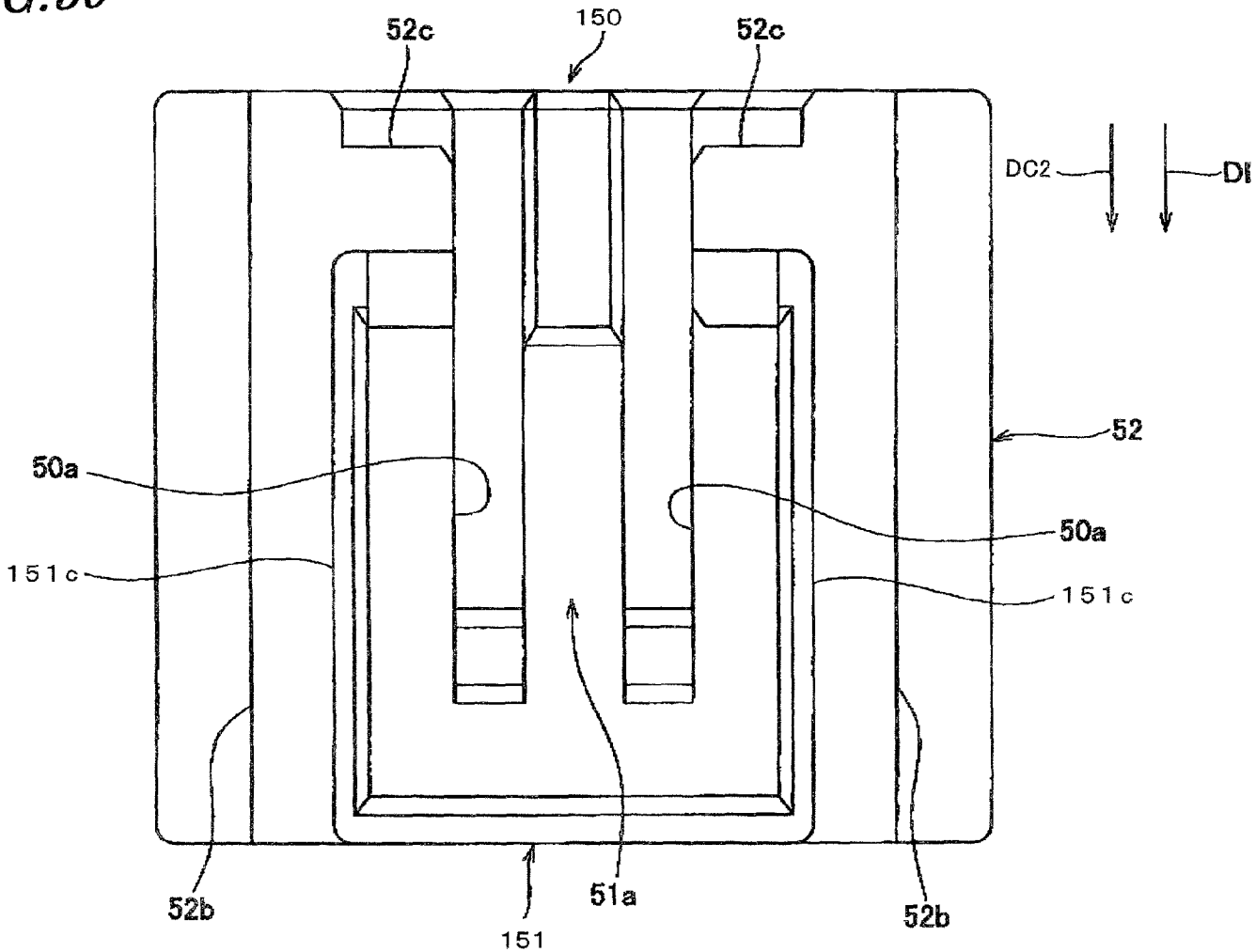
FIG. 30 is a bottom view of the housing shown in FIG. 28.
Figure 31:
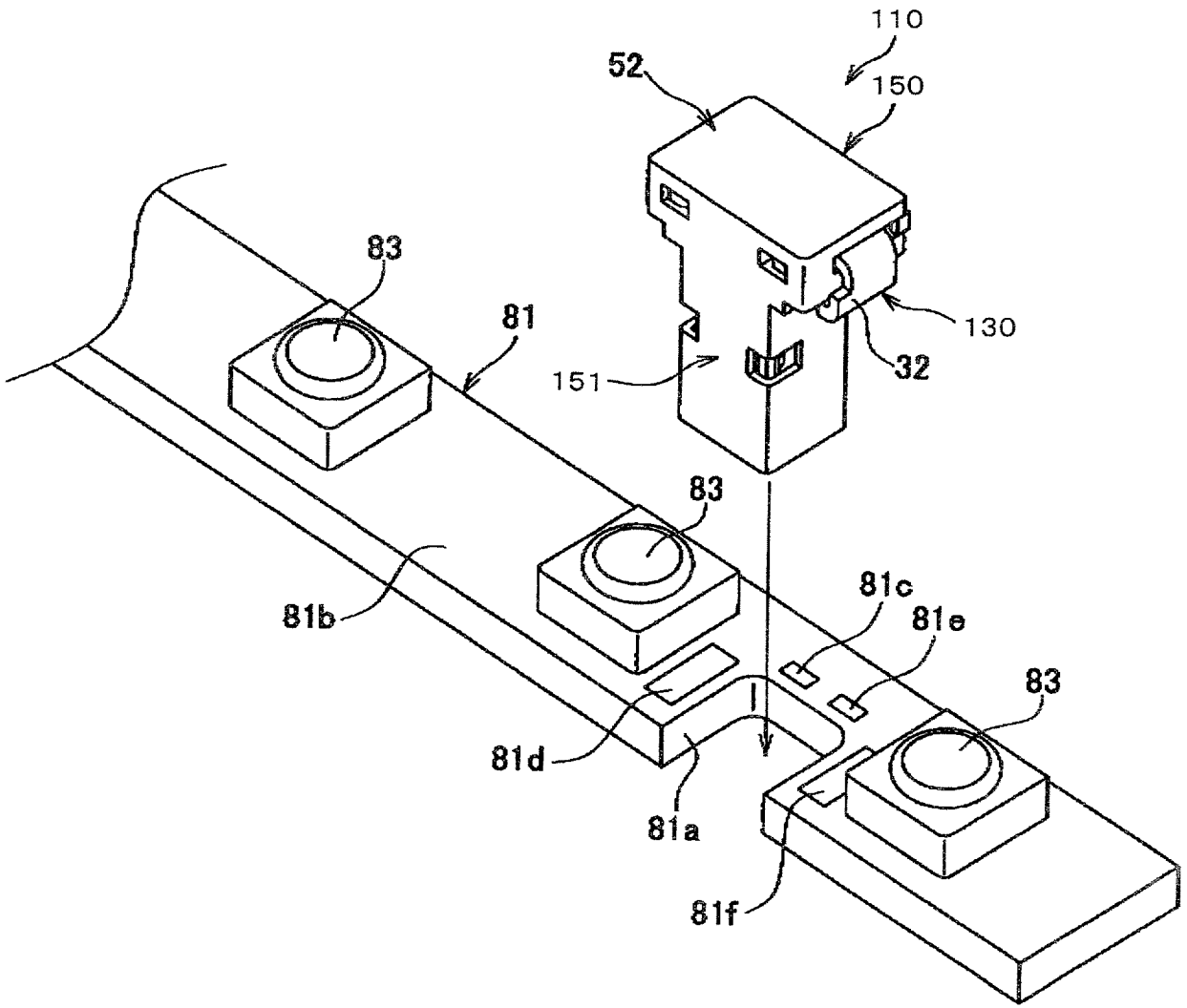
FIG. 31 is a perspective view of the connector in a state before being mounted on an LED-mounted substrate.

From the top plate portion 52 to the housing main body 151, the two slots 50*a* are formed (see FIGS. 28 and 30). Each slot 50*a* receives the wide portion 134*a* of the contact portion 134 of the contact 130.

Next, a description of the cable connector 70, which is a mating connector of the connector 110, will be given with reference to FIGS. 32 to 35. The cable connector 70 comprises the housing 71 and a contact (not shown). The housing 71 includes a housing main body 71*c* and the two locking arms 71*a* and 71*a*. The housing main body 71*c* is substantially hollow rectangular prism-shaped, and holds the contact. Fixed end portions of the locking arms 71*a* and 71*a* are continuous with the side surface portions of the housing main body 71*c*, respectively. Free ends of the locking arms 71*a* and 71*a* (see FIGS. 33 and 34) are formed with the nails 71*b* and 71*b*, respectively, and the distance between the nails 71*b* and 71*b* is configured to be narrower than the distance between the opposite surface portions 151*c* and 151*c* of the housing 150. The nails 71*b* and 71*b* of the locking arms 71*a* and 71*a* are engaged respectively with the holes 151*e* and 151*e* of the housing main body 151. When the nails 71*b* and 71*b* of the locking arms 71*a* and 71*a* are engaged respectively with the holes 151*e* and 151*e* of the housing main body 151, a predetermined small gap g is formed between each of the locking arms 71*a* and 71*a* and the LED-mounted substrate 81 (see FIG. 35).

Figure 32:
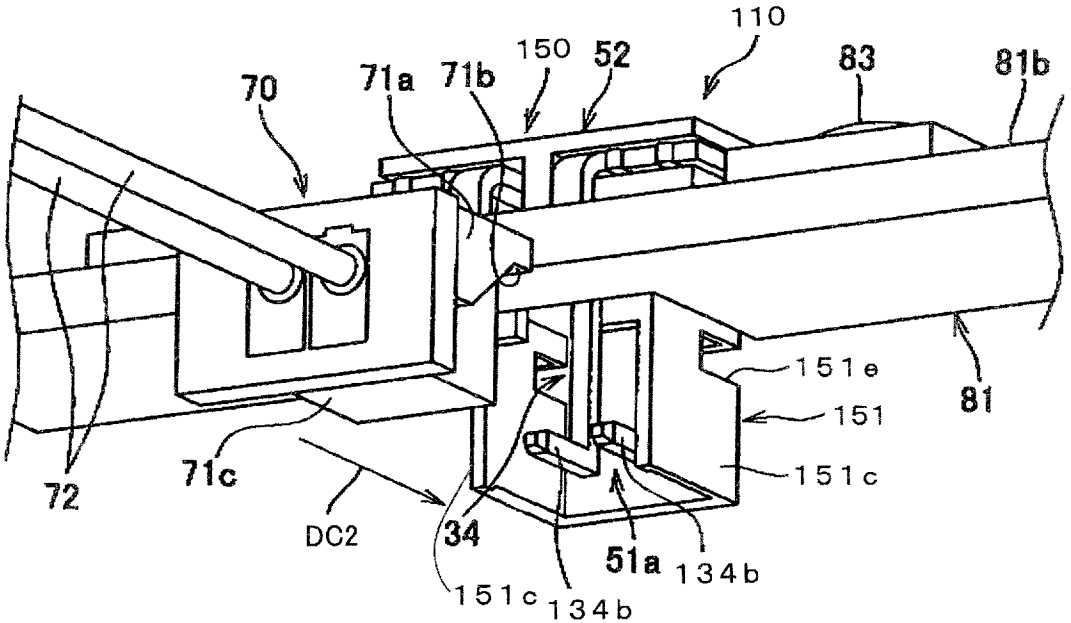
FIG. 32 is a perspective view of the connector, which is mounted on the LED-mounted substrate, in a state before being connected to a cable connector.
Figure 33:
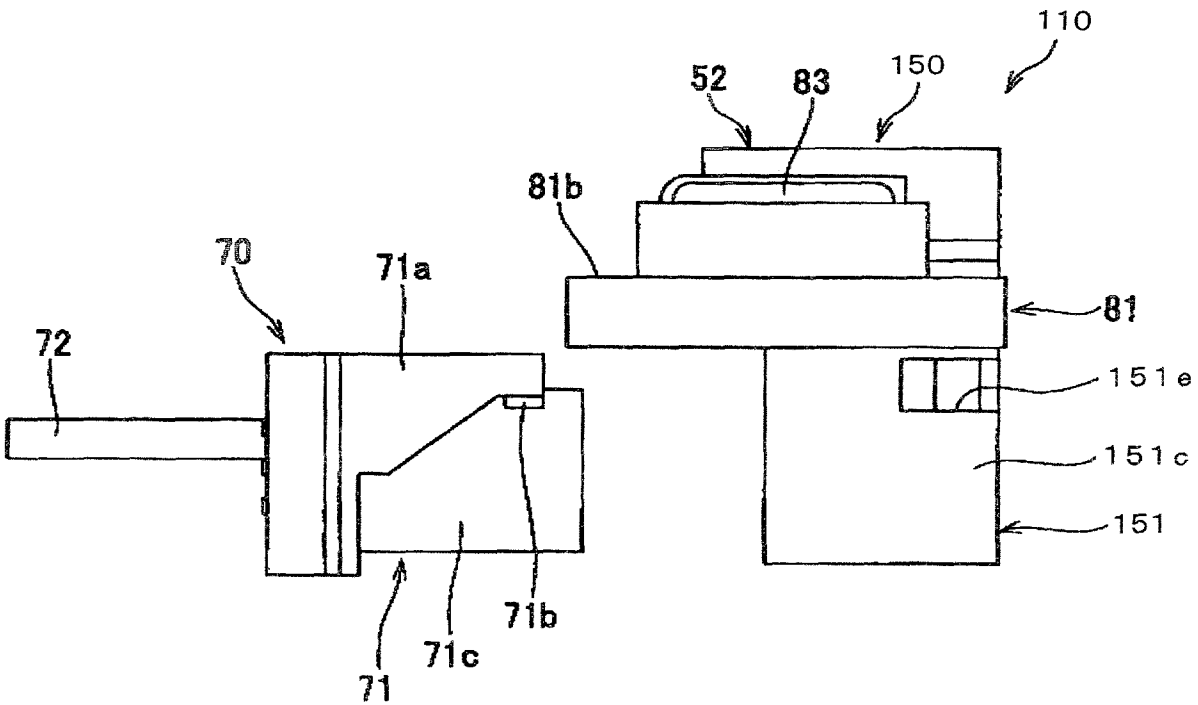
FIG. 33 is a side view of the connector, which is mounted on the LED-mounted substrate, in the state before being connected to the cable connector.
Figure 34:
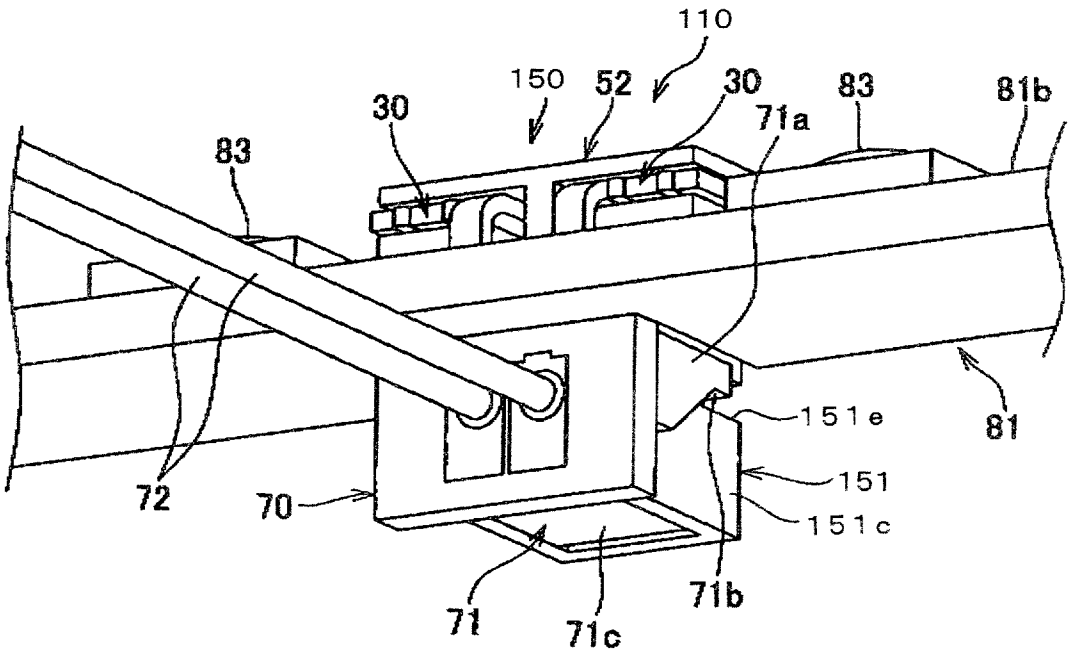
FIG. 34 is a perspective view of the connector, which is mounted on the LED-mounted substrate, in a state connected to the cable connector.
Figure 35:
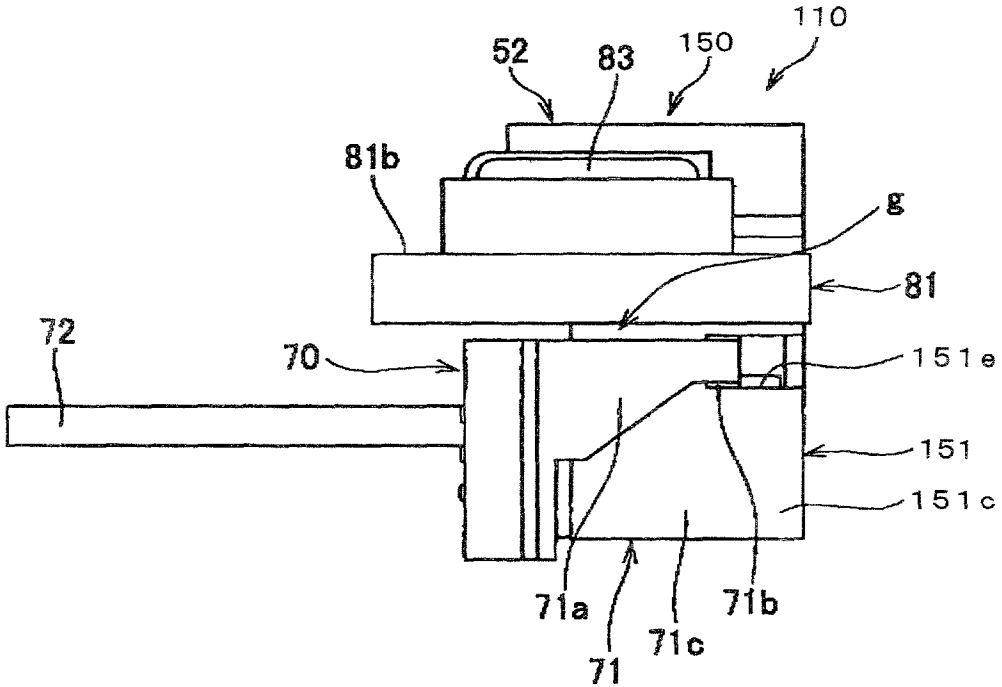
FIG. 35 is a side view of the connector, which is mounted on the LED-mounted substrate, in the state connected to the cable connector.
Figure 36:
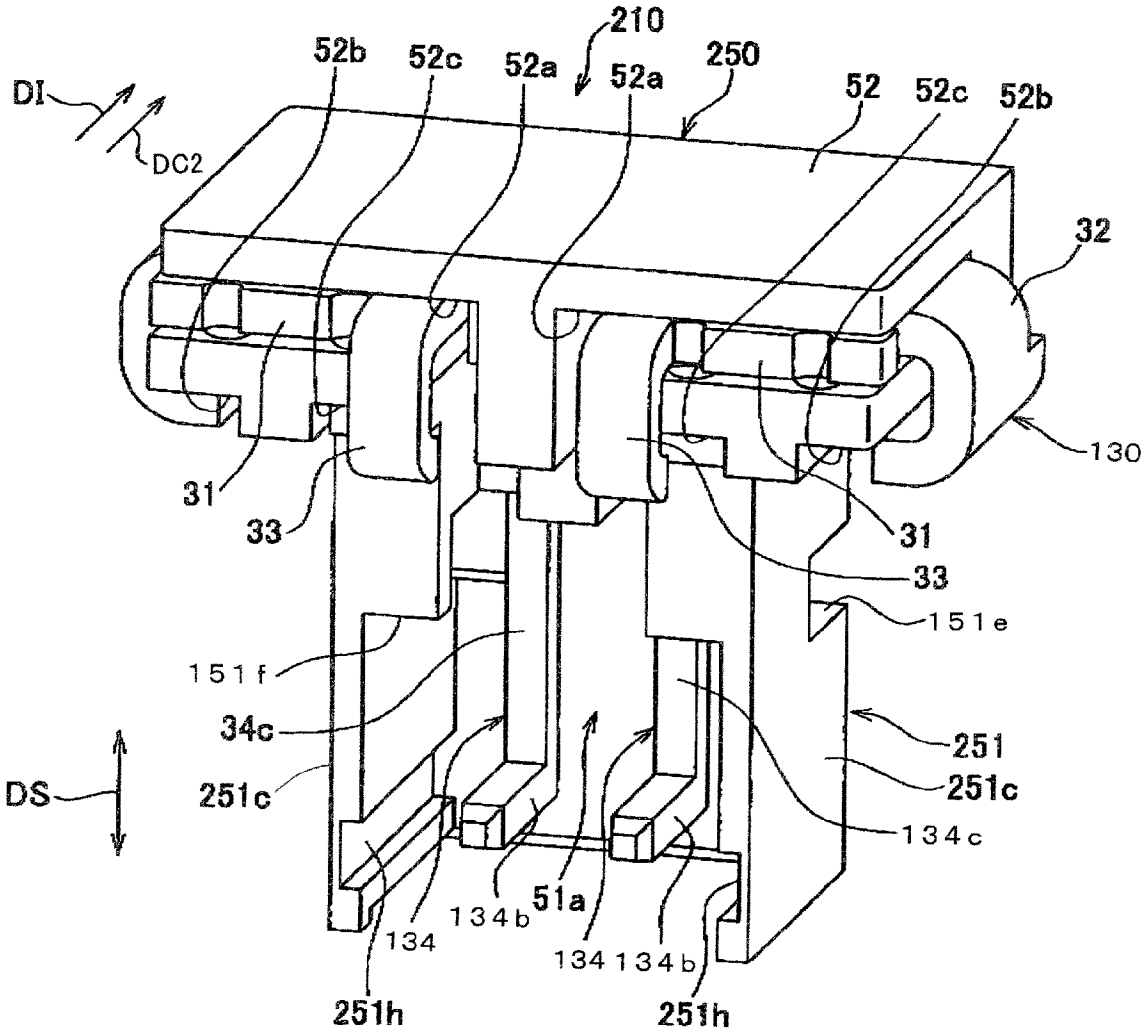
FIG. 36 is a perspective view of a connector according to a third embodiment of the present invention.
Figure 37:
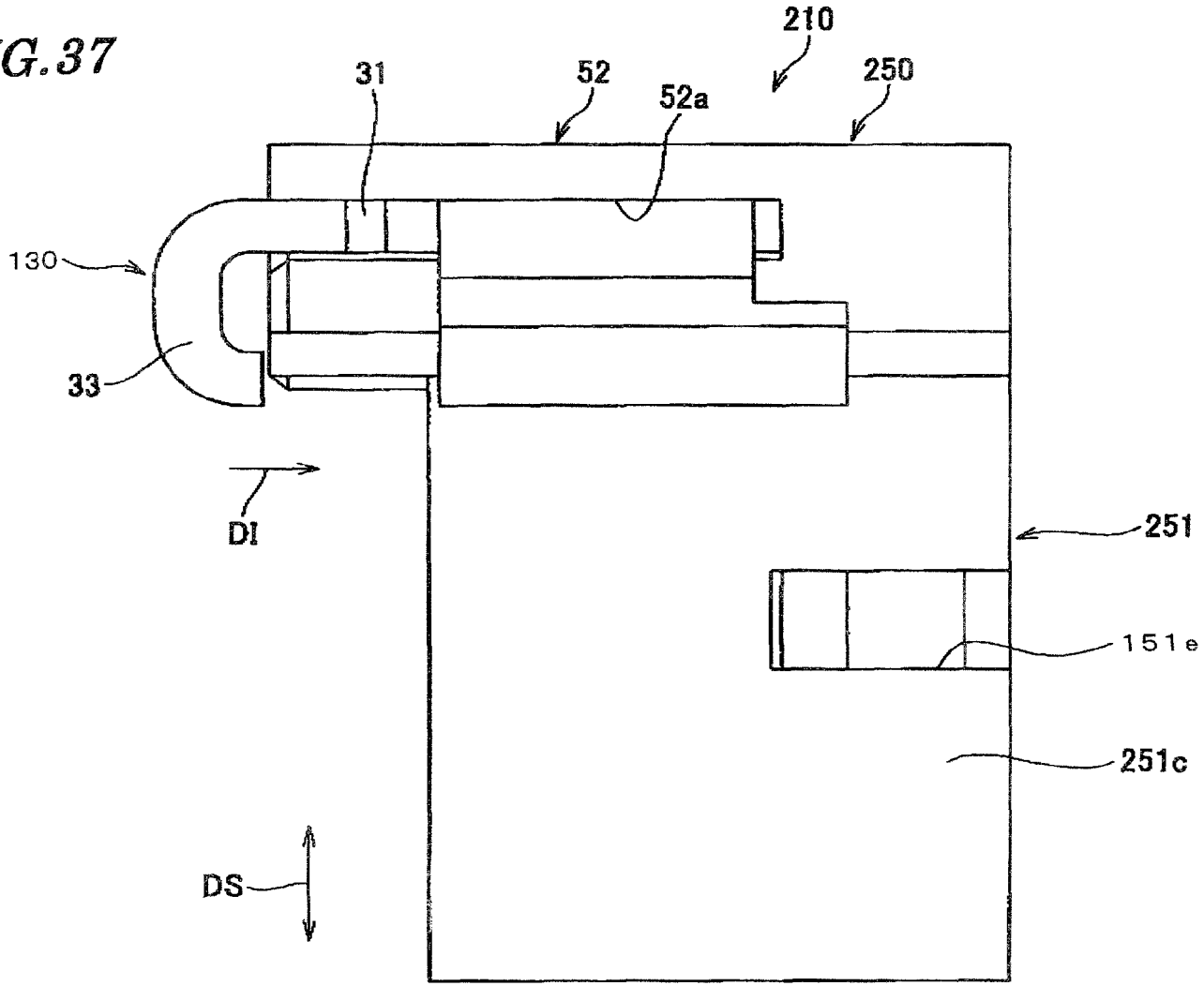
FIG. 37 is a side view of the connector shown in FIG. 36.
Figure 38:
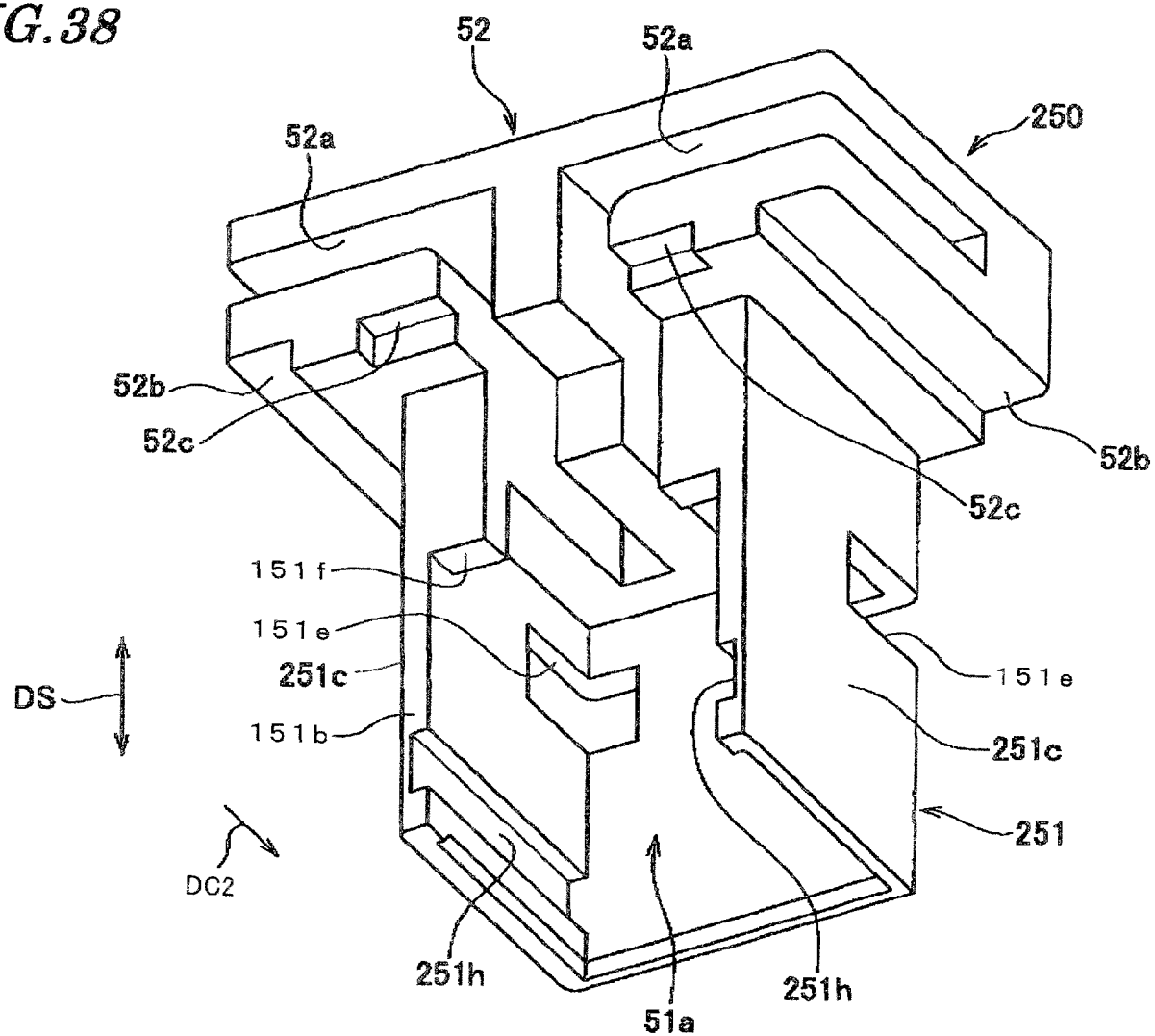
FIG. 38 is a perspective view of a housing of the connector shown in FIG. 37, taken obliquely from below.
Figure 39:
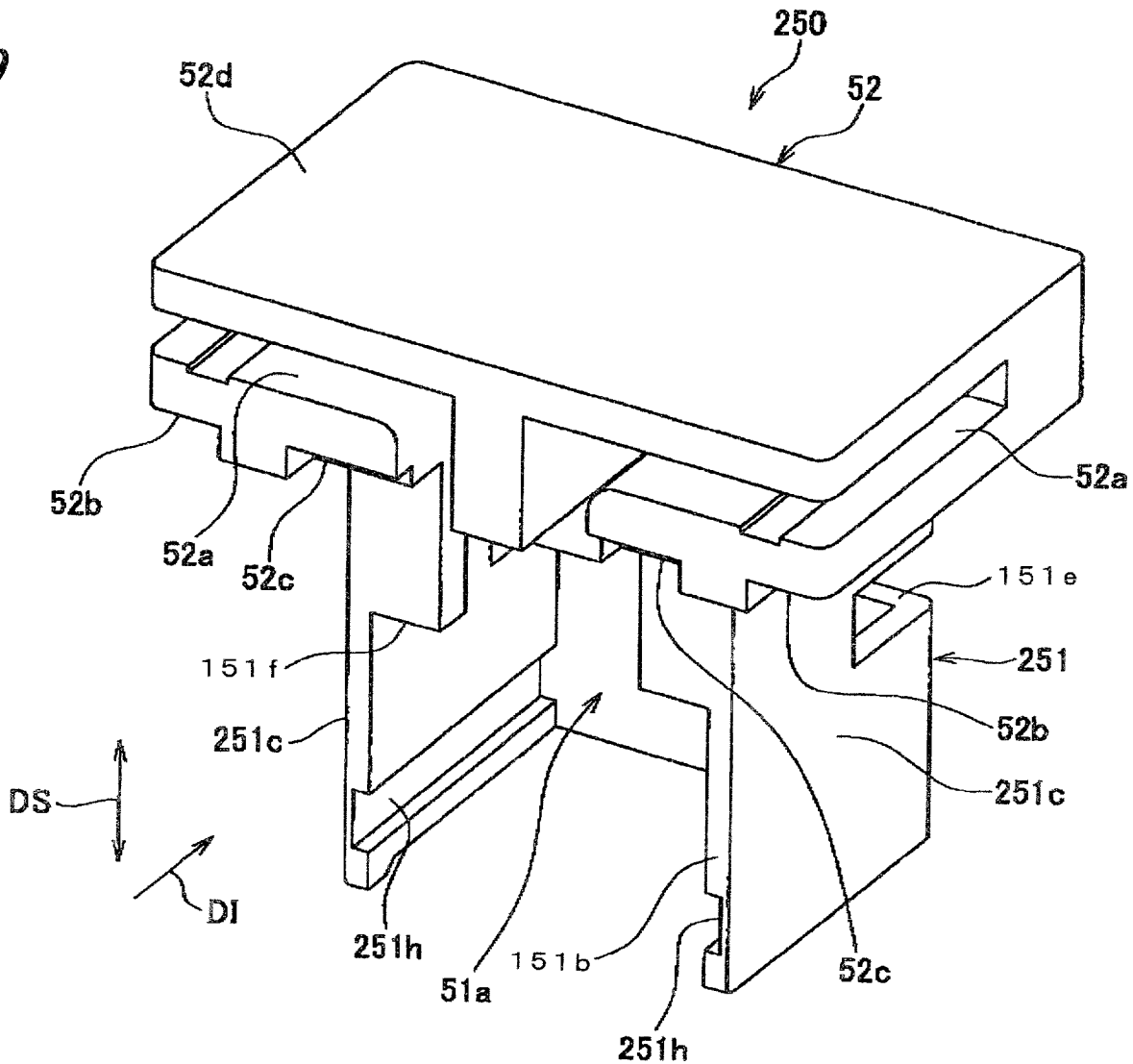
FIG. 39 is a perspective view of the housing of the connector shown in FIG. 37, taken obliquely from above.
Figure 40:
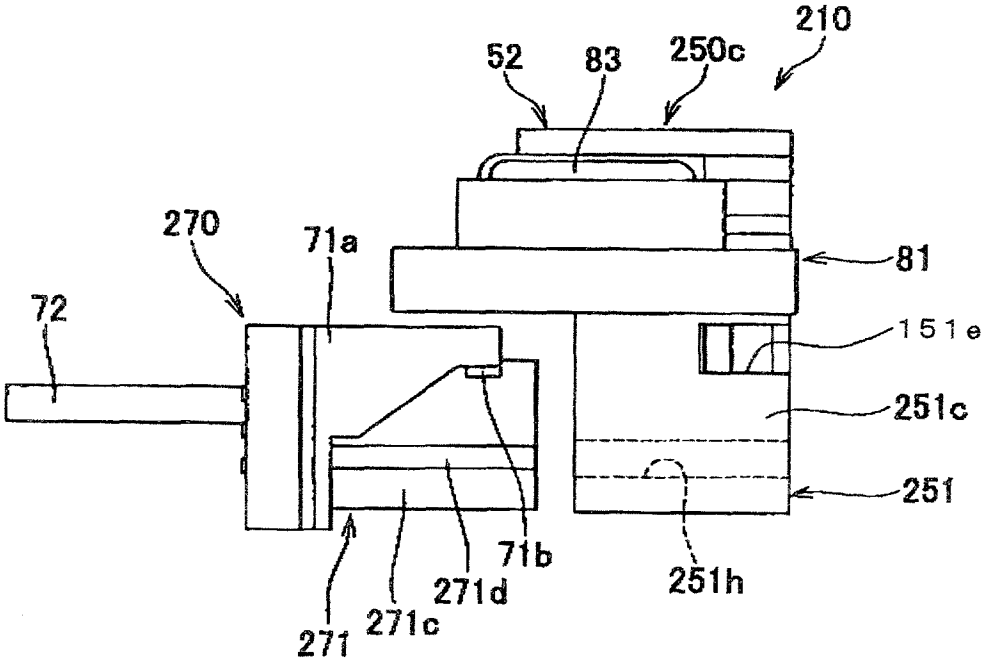
FIG. 40 is a side view of the connector, which is mounted on an LED-mounted substrate, in a state before being connected to a cable connector.

To connect the cable connector 70 to the connector 110, the cable connector 70 is fitted to the connector 110 from front of the connector 110, along the connector fitting direction DC2, as shown in FIGS. 32 and 33.

When fitting the cable connector 70 to the connector 110, the locking arms 71*a* and 71*a* are elastically deformed, and the nails 71*b* and 71*b* slide on the opposite surface portions 151*c* and 151*c* of the housing main body 151. When the nails 71*b* and 71*b* reach the holes 151*e* and 151*e*, the nails 71*b* and 71*b* enter the holes 151*e* and 151*e* by the elastic forces of the locking arms 71*a* and 71*a*. At this time, a click is produced, which makes it possible to perceive that the cable connector 70 has been properly fitted to the connector 110. Therefore, if a connection work of the connector 110 and the cable connector 70 is done while paying attention to a click produced when the nails 71*b* and 71*b* are fitted to the holes 151*e* and 151*e*, it is possible to know that the cable connector 70 has been positively electrically connected to the connector 110.

Further, when fitting the cable connector 70 to the connector 110 from the connector fitting direction DC2, the gap g formed between the upper surface of the locking arm 71*a* and the reverse surface of the LED-mounted substrate 81 is very small. Therefore, even when the cable connector 70 is about to be inclined with respect to the reverse surface of the LED-mounted substrate 81, the upper surface of the locking arm 71*a* of the cable connector 70 is brought into contact with the reverse surface of the LED-mounted substrate 81, whereby the inclination of the cable connector 70 is suppressed.

According to this embodiment, it is possible to obtain advantageous effects as provided by the first embodiment.

Further, since the connector receiving portion 51*a* of the housing 150 receives the cable connector 70 from the connector fitting direction DC2 which is orthogonal to the direction DS along which the housing main body 151 is continuous with the top plate portion 52, the amount of protrusion of the housing 150 from the reverse surface of the LED-mounted substrate 81 can be reduced.

Therefore, if the connector 110 is used as the connector which supplies power to an LED of the backlight of the liquid crystal television, there is no need to secure large space for fitting the cable connector 70 to the connector 110 on the reverse side of the LED-mounted substrate 81, and there is no need to bend the cable 72 of the cable connector 70 into a right angle. Therefore, it is possible to realize thinning of a liquid crystal television.

Further, since the contacting portion 134*b* of the contact portion 134 of the contact 130 of the connector 110 extends in the parallel direction to the inserting direction DI, the area of contact between the contact portion 134 and the mating contact of the cable connector 70 can be increased, and the contact stability of the two contacts is improved.

Further, the bottom surface of the housing main body 151 is formed to be open, and no bottom surface portion of the housing main body 151 exists. This contributes to reduction of the amount of protrusion of the housing main body 151 from the reverse side of the LED-mounted substrate 81.

Further, the opposite side surface portions 151*c* of the housing main body 151 are formed with the holes 151*e*, respectively, and the nails 71*b* and 71*b* of the locking arms 71*a* and 71*a* of the cable connector 70 are engaged respectively with the two holes 151*e* and 151*e*. This enhances the fitting strength between the cable connector 70 and connector 110.

Further, when the cable connector 70 is fitted to the connector 110, the gap g formed between the upper surface of the locking arm 71*a* and the reverse surface of the LED-mounted substrate 81 is very small. Therefore, even if the cable connector 70 is about to be inclined with respect to the reverse surface of the LED-mounted substrate 81, the locking arm 71*a* of the cable connector 70 is brought into contact with the reverse surface of the LED-mounted substrate 81, which suppresses the inclination of the cable connector 70, whereby the cable connector 70 can be fitted properly to the connector 110 with ease.

Next, a description will be given of a connector according to a third embodiment of the present invention with reference to FIGS. 36 to 40. Components common to the first embodiment are denoted by the same reference numerals, and detailed description thereof is omitted.

The inner wall surface (inner wall surface of the connector receiving portion 51*a*) of a side surface portion 251*c* of a housing main body 251 of the housing 250 of the connector 210 is formed with a key slot 251*h*. The key slot 251*h* extends in the connector fitting direction DC2. The key slot 251*h* guides a key 271*d*, referred to hereinafter, in the connector fitting direction DC2.

The outer surface of the side surface portion of a housing main body 271*c* of a housing 271 of a cable connector 270 is formed with the key 271*d*. The key 271*d* extends in the connector fitting direction DC2, and is inserted into the key slot 251*h* of the connector 210.

According to the third embodiment, it is possible to obtain advantageous effects as provided by the second embodiment, and it is possible to properly fit the cable connector 270 to the connector 210 more easily.

Note that although in the above-described embodiments, the contacting portion 134*b* of the contact portion 134 of the contact 130 of the connector 110, 210 extends in the connector fitting direction DC2, it is not necessarily required to extend the contacting portion 134*b* in the connector fitting direction DC2.

Although in the above-described embodiments and variation, the connector 10, 110, and 210 comprises two contacts 30, 130, the number of contacts 30 is not limited to two, but the number may be one, or three or more.

Further, although in the above-described embodiments and variation, the cutout 81*a* is adopted as an inserted portion of the contact 10, 110, 210, the inserted portion 81*a* is not necessarily limited to a cutout, but a hole, for example, may be adopted.

Note that although in the above-described embodiments and variation, the dowel 31*d* is provided on the holding portion 31 of the contact 30, 130, the dowel 31*d* may not be provided.

Further, although in the above-described embodiments and variation, the connection portion 32, 33 is bent into a substantially U-shape, the connection portion 32, 33 may be bent, for example, into a J-shape or an arc shape.

Note that although in the above-described embodiments and variation, the contact 30, 130 includes the two connection portions 32, 33, the number of connection portions is not limited to two, the number may be one, or three or more.

Further, although in the above-described embodiments and variation, the connector 10, 110, 210 supplies power to the LED-mounted substrate 81, the connector of the present invention is not limited to a power supply connector.

It is further understood by those skilled in the art that the foregoing are the preferred embodiment of the present invention, and that various changes and modification may be made thereto without departing from the spirit and scope thereof.

Reference Signs List

10, 110, 210: connector
30, 130: contact
31: holding portion
31*e*: protrusion (first protrusion)
31*d*: dowel (second protrusion)
32, 33: connection portion
34, 134: contact portion
50, 150, 250: housing
51, 151, 251: housing main body
51*a*: connector receiving portion
52, 252: top plate portion
52*a*: holding portion-receiving portion
70, 270: cable connector (mating connector)
71, 271: housing (mating housing)
81: LED-mounted substrate (substrate)
81*a*: cutout (inserted portion)
81*b*: mounting surface
134*a*: wide portion
134*b*: contact portion
134*c*: connecting portion
151*c*, 251*c*: side surface portion
151*e*: hole
151*f*: opening
251*h*: key slot
271*c*: housing main body
271*d*: key
DI: inserting direction
DC1, DC2: connector fitting direction

The invention claimed is:

1. A connector mounted on a substrate, for being fitted to a mating connector, the connector including a contact, and a housing which holds the contact, wherein the contact includes a holding portion which is held by the housing, a connection portion which is continuous with the holding portion and is connected to the mounting surface of the substrate, and a contact portion which is continuous with the holding portion and is brought into contact with the mating contact of the mating connector, wherein the housing includes a housing main body which is inserted in a inserted portion formed in the substrate, and a top plate portion which is continuous with the housing main body and opposes to the substrate, wherein the housing main body has a connector receiving portion formed therein which accommodates the contact portion and receives the mating housing of the mating connector, wherein the top plate portion has a holding portion-receiving portion formed therein which receives the holding portion from an inserting direction orthogonal to a direction along which the housing main body is continuous with the top plate portion, and wherein the connection portion protrudes from the top plate portion in a direction parallel to the inserting direction, and the front end of the contact portion is bent toward the housing.

2. The connector as claimed in claim 1, wherein the inserting direction in which the holding portion is inserted to the holding portion-receiving portion is orthogonal to a connector fitting direction in which the mating connector is fitted to the connector receiving portion.

3. The connector as claimed in claim 1, wherein the holding portion is flat plate-shaped, and wherein the holding portion includes a first protrusion which bites into an inner wall surface of the holding portion-receiving portion and a second protrusion which urges an inner wall surface of the holding portion-receiving portion.

4. The connector as claimed in claim 2, wherein the holding portion is flat plate-shaped, and wherein the holding portion includes a first protrusion which bites into an inner wall surface of the holding portion-receiving portion and a second protrusion which urges an inner wall surface of the holding portion-receiving portion.

5. The connector as claimed in claim 1, wherein the contact almost in its entirety is covered by the top plate portion when the top plate portion is viewed from above.

6. The connector as claimed in claim 2, wherein the contact almost in its entirety is covered by the top plate portion when the top plate portion is viewed from above.

7. The connector as claimed in claim 3, wherein the contact almost in its entirety is covered by the top plate portion when the top plate portion is viewed from above.

8. The connector as claimed in claim 4, wherein the contact almost in its entirety is covered by the top plate portion when the top plate portion is viewed from above.

9. The connector as claimed in claim 1, wherein the connection portion is substantially U-shaped.

10. The connector as claimed in claim 1, wherein the contact includes the connection portion in plurality.

* * * * *